US007057023B2

(12) United States Patent
Islam et al.

(10) Patent No.: US 7,057,023 B2
(45) Date of Patent: Jun. 6, 2006

(54) METHODS AND APPARATUS FOR SPINNING SPIDER SILK PROTEIN

(75) Inventors: Shafiul Islam, Hawkesbury (CA); Costas Karatzas, Beaconsfield (CA); Andrew Rodenhiser, Montreal (CA); Ali Alwattari, Point Claire (CA); Yue Huang, Vaudreuil-Dorian (CA); Carl Turcotte, Montreal (CA)

(73) Assignee: Nexia Biotechnologies Inc., Montreal (CA)

( * ) Notice: Subject to any disclaimer, the term of this patent is extended or adjusted under 35 U.S.C. 154(b) by 0 days.

(21) Appl. No.: 10/406,832

(22) Filed: Apr. 3, 2003
(Under 37 CFR 1.47)

(65) Prior Publication Data

US 2004/0102614 A1 May 27, 2004

Related U.S. Application Data

(63) Continuation-in-part of application No. 10/341,096, filed on Jan. 13, 2003, now abandoned.

(60) Provisional application No. 60/347,510, filed on Jan. 11, 2002, provisional application No. 60/408,530, filed on Sep. 4, 2002.

(51) Int. Cl.
*C07K 14/00* (2006.01)

(52) U.S. Cl. ..... 530/412; 530/350

(58) Field of Classification Search ..... 530/350, 530/412
See application file for complete search history.

(56) References Cited

U.S. PATENT DOCUMENTS

| | | | | |
|---|---|---|---|---|
| 5,728,810 | A | 3/1998 | Lewis et al. | |
| 5,733,771 | A | 3/1998 | Lewis et al. | |
| 5,756,677 | A | 5/1998 | Lewis et al. | |
| 5,907,080 | A | 5/1999 | Karatzas et al. | |
| 5,989,894 | A | 11/1999 | Lewis et al. | |
| 5,994,099 | A | 11/1999 | Lewis et al. | |
| 6,268,169 | B1 * | 7/2001 | Fahnestock | 435/69.1 |
| 2001/0042255 | A1 | 11/2001 | Karatzas et al. | |

FOREIGN PATENT DOCUMENTS

| | | |
|---|---|---|
| WO | WO 94/29450 | 12/1994 |
| WO | WO 99/47661 | 9/1999 |
| WO | WO 01/53333 | 7/2001 |
| WO | WO 01/94393 | 12/2001 |

OTHER PUBLICATIONS

Esaka M et al., 1989, Stimulation of ascorbate oxidase secretion from cultured pumpkin cells by divalent cations, Phytochem. 28(10):2655-2658.

Esaka M et al., 1994, Secretion of basic and acidic chitinases from salt-adapted and -unadapted winged bean cells, Physiologia Plantarus 92:90-96.

Esaka M & Hayakawa H, 1995, Specific secretion of proline-rich proteins by salt-adapted winged bean cells, Plant Cell Physiol. 36(3):441-446.

Fahnestock S et al., 2000, Microbial production of spider silk proteins, Reviews in Mol Biotechnol. 74:105-119.

Gill S & Von Hippel P, 1989, Calculation of protein extinction coefficients from amino acid sequence data, Anal Biochem. 182:319-326.

Gosline JM et al., 1986, The structure and properties of spider silk, Endeavour 10(1):37-43.

Gosline JM et al., 1999, The mechanical design of spider silks: from fibroin sequence to mechanical function, J Exp Biol. 202:3295-3303.

Guerette P et al., 1996, Silk properties determined by gland-specific expression of a spider fibroin gene family, Science 272:112-115.

Hayashi C & Lewis R, 1998, Evidence from flagelliform silk cDNA for the structural basis of elasticity and modular nature of spider silks, J Mol Biol. 275:773-784.

Heinrikson R & Meredith S, 1984, Amino acid analysis by reverse-phase high-performance liquid chromatography: precolumn derivatization with phenylisothiocyanate, Anal Biochem. 136:65-74.

Hinman M & Lewis R, 1992, Isolation of a clone encoding a second dragline silk fibroin: nephila calvipes dragline silk is a two-protein fiber, J Biol Chem. 267(27):19320-19324.

Hinman M et al., 2000, Synthetic spider silk: a modular fiber, Trends Biotechnol. 18:374-379.

Huynh H et al., 1991, Establishment of bovine mammary epithelial cells (MAC-T): an in vitro model for bovine lactation, Exp Cell Res. 197:191-199.

Lewis R et al., 1996, Expression and purification of a spider silk protein: a new strategy for producing repetitive proteins, Protein Expr Purif. 7:400-406.

Li J et al., 1997, Secretion of active recombinant phytase from soybean cell-suspension cultures, Plant Physiol. 114:1103-1111.

Lucas F, 1964, Spiders and their silks, Discovery 25(1):20-26.

Parent JG & Asselin A, 1984, Detection of pathogenesis-related proteins (PR or b) and of other proteins in the intercellular fluid of hypersensitive plants infected with tabacco mosaic virus, Can. J. Bot. 62:564-569.

(Continued)

*Primary Examiner*—Karen Cochrane Carlson
(74) *Attorney, Agent, or Firm*—Jones Day

(57) ABSTRACT

The invention features methods and apparatuses for spinning silk protein fibers (biofilaments) from recombinant biofilament proteins. The methods are particularly useful for spinning fibers of spider silk or silkworm silk proteins from recombinant mammalian cells and may be used to spin such fibers for use in the manufacture of industrial and commercial products.

31 Claims, 9 Drawing Sheets

OTHER PUBLICATIONS

Sambrook J & Russell D, 2001, Molecular Cloning: A Laboratory Manual, 3rd ed. Cold Spring Harbor Laboratory Press.

Scheller J et al., 2001, Production of spider silk proteins in tabacco and potato, Nat Biotechnol. 19:573-577.

Vollrath F & Knight D, 2001, Liquid crystalline spinning of spider silk, Nature, 410:541-548.

Vollrath F, 2000, Strength and structure of spiders' silks, Rev. Mol. Biotechnol. 74:67-83.

Xu M & Lewis R, 1990, Structure of a protein superfiber: spider dragline silk, Proc Natl Acad Sci USA, 87:7120-7124.

* cited by examiner

```
SEQ         MaSpl_Translation (M4)
KEYWORD     PROTEIN
ORIGIN
QGAGAAAAAAA GGAGQGGYGG                          LGSQGAGRGG
QGAGAAAAAA  GGAGQGGYGG                          LGSQGAGRGGLGG
QGAGAAAAAAA GGVGQGG                   LGGQGAG
QGAGAAAAAA  GGAGQGGYGG                          LGSQGAGRGGSGG
QGAGAAAAAA  GGAGQGGYGG                          LGSQGAGRGGLGG
QGAGAAAAAAA GGAGQGGYGG                LGGQGAGQGGYGG LGSQGAGRGGLGG
QGAGAAAAAAA GGAGQGG                   LGGQGAG
QGAGAAAAAA  GGAGQGGYGG                          LGSQGAGRGG
QGAGAAAAAA  VGAGQGGYGGQGAGQGGYGG                LGSQGAGRGGLGG
QGAGAAAAAAA GGAGQGG                   LGGQGAG
QGAGAAAAAA  GGAGQGGYGG                          LGNQGAGRGG
QGAAAAAAGGA    GQGGYGG                          LGSQGAGRGGLGG
QGAGAAAAAA  GGAGQGGYGG                LGGQGAGQGGYGG LGSQGSGRGGLGG
QGAGAAAAAA  GGAGQGG                   LGGQGAG
QGAGAAAAAA  GGVRQGGYGG                          LGSQGAGRGG
QGAGAAAAAA  GGAGQGGYGG                LGGQGVGRGG LGG
QGAGAAAA    GGAGQGGYGG
VGSGASAASAAASRLSSPQASSRVSSAVSNLVASGPTNSAALSSTISNVVSQIGASNPGLSGCDVLIQALLEVVSALI
QILGSSSIGQVNYGSAGQATQIVGQSVYQAL
```

FIG. 6

```
SEQ        MaSp2 Translation
KEYWORD     PROTEIN
ORIGIN
            PGGYGPGQQGPGGYGPGQQGP            SGPGS      AAAAAAAAAA
GPGGYGPGQQGPGGYGPGQQGPGRYGPGQQGP             SGPGS      AAAAAA
     GSGQQGPGGYGPRQQGPGGYGQGQQGP             SGPGS      AAAASAAASA
     LSGQQGPGGYGPGQQGPGGYGPGQQGPGGYGPGQQGP   SGPGS      AAAAAAAA
    SGPGQQGPGGYGPGQQGPGGYGPGQQGP             SGPGS      AAAAAAAA
    SGPGQQGPGGYGPGQQGPGGYGPGQQGL             SGPGS      AAAAAAA
     GPGQQGPGGYGPGQQGP                       SGPGS      AAAAAAAAA
GPGGYGPGQQGPGGYGPGQQGP                       SGADS      AAAAAAA
     GPGQQGLGGYGPGQQGPGGYGPGQQGPGGY          GPGS       ASAAAAAA
     GPGQQGPGGYGPGQQGP                       SGPGS      ASAAAAAAAA
GPGGYGPGQQGPGGYAPGQQGP                       SGPGS      ASAAAAAAAA
GPGGYGPGQQGPGGYAPGQQGP                       SGPGS      AAAAAAAAA
GPGGYGPAQQGP                                 SGPGI      AASAASA
GPGGYGPAQQGPAGY                               GPGS      AVAASAGAGSA
GYGPGSQASAAASRLASPDSGARVASAVSNLVSSGPTSSAALSSVISNAVSQIGASNPGLSGCDVLIQALLEIVSACV
TILSSSSIGQVNYGAASQFAQVVGQSVLSAF
```

FIG. 7

Translation of Adf3(1-3410)
Universal code
Total amino acid number: 1130, MW=115213
Max ORF: 1-3270, 1090 AA, MW=110427 adf-3 TRANSLATION

AAA

```
                GSGQQGPGQQGPGQQGPGQQGP                                  YGPG
ASAAAAAA GGYGPGSGQQGPSQQGPGQQGPGGQGP                                    YGPG
ASAAAAAA GGYGPGSGQQGPGGQGP                                              YGPG
SSAAAAAA GGNGPGSGQQGAGQQGPGQQGPG
ASAAAAAA GGYGPGSGQQGPGQQGPGGQGP                                         YGPG
ASAAAAAA GGYGPGSGQ-GPGQQGPGGQGP                                         YGPG
ASAAAAAA GGYGPGSGQQGPGQQGPGQQGPGGQGP                                    YGPG
ASAAAAAA GGYGPGYGQQGPGQQGPGGQGP                                         YGPG
ASAASAAS GGYGPGSGQQGPGQQGPGGQGP                                         YGPG
ASAAAAAA GGYGPGSGQQGPGQQGPGQQGPGQQGPGGQGP                               YGPG
ASAAAAAA GGYGPGSGQQGPGQQGPGQQGPGQQGPGQQGPGQQGPGQQGPGQQGPGGQGA          YGPG
ASAAAGAA GGYGPGSGQQGPGQQGPGQQGPGQQGPGQQGPGQQGPGQQGPGQQGP                YGPG
ASAAAAAA        GQQGPGQQGPGQQGEGGQGP                                    YGPG
AASAAVSV GGYGPGS
SSVPVASAVASRLSSPAASSRVSSAVSSLVSSGPTKHALLSNTISSVVSQVSASNPGLSGCDVLVQALLEVVSALVSI
LGSSSIGQINYGASAQYTQMVGQSVAQALA
```

FIG. 8

METHODS AND APPARATUS FOR SPINNING SPIDER SILK PROTEIN

This application is a continuation-in-part Application of application Ser. No. 10/341,096, filed Jan. 13, 2003, now abandoned, which is entitled to and claims priority benefit under 35 U.S.C. § 119(e) to U.S. Provisional Applications No. 60/347,510, filed Jan. 11, 2002, and No. 60/408,530, filed Sep. 4, 2002, which are each incorporated herein by reference in their entireties.

1. INTRODUCTION

This invention relates to methods and devices for spinning biofilament proteins into fibers. This invention is particularly useful for spinning recombinant silk proteins from aqueous solutions and enhancing the strength of the fibers and practicality of manufacture such as to render commercial production and use of such fibers practicable.

2. BACKGROUND OF THE INVENTION

Spider silks are proteinaceous fibers composed largely of non-essential amino acids. Orb-web spinning spiders have as many as seven sets of highly specialized glands and produce up to seven different types of silk. Each silk protein has a different amino acid composition, mechanical property, and function. The physical properties of a silk fiber are influenced by the amino acid sequence, spinning mechanism, and environmental conditions in which it was produced.

The dragline silk of *A. diadematus* demonstrates high tensile strength (1.9 Gpa; ~15 gpd) approximately equivalent to that of steel (1.3 Gpa) and synthetic fibers such as aramid fibers (e.g., Kevlar™). The physical properties of dragline silk balance stiffness and strength, both in extension and compression, imparting the ability to dissipate kinetic energy without structural failure. The utility of spider silk proteins as "super filaments" has led to attempts to produce these silks in large quantities.

Previous efforts at generating commercial fibers from spider silk proteins have proven unavailing, with particular problems evident in maintaining stability, integrity, and workability of the fibers. The present invention offers an innovative solution to this problem with advancements to the procedural steps, apparatus and working materials used, culminating in the result of production of uniform and stable commercially viable quantities of spider silk fiber.

3. SUMMARY OF THE INVENTION

The present invention provides apparatuses and methods for spinning biofilament fibers from recombinant spider silk proteins, which fibers are of sufficient tensile strength and uniformity to be useful for commercial purposes. The methods of the invention encompass wet spinning, dry spinning, melt spinning, or electrospinning fibers or filaments from spider silk proteins. In a preferred embodiment, biofilament fibers are wet spun from an aqueous dope solution of recombinant spider silk proteins.

According to the methods of the invention, a dope solution of spider silk protein is extruded through a spinneret to form a biofilament. The resulting biofilament can be drawn or stretched. Because both crystalline and amorphous arrangements of molecules exist in biofilaments, drawing or stretching will apply shear stress sufficient to orient the molecules to make them more parallel to the walls of the filament, therefore more crystalline, and increase the tensile strength and toughness of the biofilament.

In preferred embodiments, the spider silk protein is produced by recombinant methods, more preferably recombinantly produced by a eukaryotic cell, most preferably by a mammalian cell, e.g., a transgenic goat mammary gland cell. The dope solution may contain a single spider silk protein, or may be a mixture of two, three, or more spider silk proteins. In certain embodiments, the dope solution contains a mixture of silk proteins from different spider species, or silk proteins from different silk-producing genera, for example, a mixture of silk proteins from spiders and *B. mori*. In the most preferred embodiments, the silk proteins are dragline silks from *N. clavipes* or *A. diadematus*, particularly the proteins MaSpI, MaSpII, ADF-3, and ADF-4. In alternate embodiments, the dope solution contains a mixture of silk proteins and one or more synthetic polymers or natural or synthetic biofilament proteins.

Preferably, the dope solution is at least 1%, 5%, 10%, 15% weight/volume (w/v) silk protein. More preferably, the dope solution is as much as 20%, 25%, 30%, 35%, 40%, 45%, or 50% w/v silk protein. In preferred embodiments, the dope solution contains substantially pure spider silk protein. In preferred embodiments, the dope has a pH of approximately 11. In one embodiment, the silk protein is in an aqueous solution. In a specific embodiment, the aqueous solution is alkaline water. In a preferred embodiment, the dope solution is aqueous and contains no more than 20%, 15%, 10%, 5%, or 1% (v/v) organic solvents or chaotropic agents. In one embodiment, the dope solution does not contain any organic solvents or chaotropic agents. In an alternate embodiment, the silk protein is dissolved in a solvent or chaotropic agent.

In preferred embodiments, the dope solution includes additives which enhance desired characteristics, e.g., stability and processability, of the dope solution. Preferred additives are gel inhibitors and/or viscosity enhancers. Particularly preferred viscosity enhancers are polymers, preferably cellulosic polymers, more preferably polyethylene oxide. Polyethylene oxide can also be a gel inhibitor. In one embodiment, polyethylene oxide, preferably having a molecular weight of 4,000,000 to 6,000,000 is added to the dope solution in concentrations of 0.03 to 2%. In another embodiment, polyethylene oxide having a molecular weight ranging from 4,000,000 to 9,000,000, or greater than 10,000,000, is added at concentrations wherein which the polyethylene oxide retains the ability to dissolve into the dope solution. The concentration depends in part on the molecular weight of the polymers; the higher the molecular weight, the lower the concentration needs to be. Preferably, the ratio of silk protein to polymer in the dope solution is no greater than 100:1.

In alternative embodiments, chemicals can be added to the dope solution to alter the properties of the biofilament. Useful additives include but are not limited to, for example, GABamide, N-acetyltaurine, choline, betaine, and isethionic acid.

Using the methods and apparatuses of this invention, the dope solution is extruded at a linear speed as low as about 0.1, 0.2, 0.4, or 0.6 m/min, or as rapidly as about 4.0, 6.0, 8.0, or 10.0 m/min. The linear speed of the fiber extruded from the dope solution is 0.1 m/min to 10.0 m/min, preferably 0.2 m/min to 8.0 m/min, more preferably 0.4 m/min to 6.0 m/min, most preferably 0.2 m/min to 4.0 m/min.

In one embodiment, the spinneret has one or more extrusion orifices of about 0.062–0.254 mm in diameter, preferably 0.1–0.15 mm in diameter, e.g., 0.127 mm diameter.

Generally, the diameter will dependent on the ultimate use of the spun fibers. A single-head spinneret has a tube length of at least about 20, 30, 40, 50, or 60 mm, up to about 100, 125, 150, 175, 200, or 300 mm in length, depending on the diameter. Single-head stainless steel spinnerets (e.g., 50–60 mm in length) are particularly useful. Spinnerets with multiple extrusion orifices have lengths of <1 mm ranging up to 3, 5, 10, 25, 50, or 100 mm in length, preferably 1 mm, 2 mm, 3 mm, or 5 mm, most preferably about 3 mm. Spinnerets with multiple extrusion orifices preferably feature a conical or funnel shape leading into the orifice, and preferably are made of polymeric materials, such as PEEK tubing. The methods of the invention encompass the use of spinnerets made of various materials, including but not limited to: metals or alloys, e.g., stainless steel and tantalum, carbon-composite materials, ceramics, or polymeric materials, e.g., PEEK. In certain embodiments, the spinneret may be sprayed with silicon or treated with TEFLON®, particularly around the needle of the spinneret to prevent adherence of the dope solution to the orifice of the spinneret.

In preferred wet-spinning embodiments, the biofilament, prior to being drawn, is extruded into a liquid coagulation bath. In one embodiment, the biofilament can be extruded through an air gap prior to contacting the coagulation bath. In an alternate embodiment, the biofilament is extruded directly into the coagulation bath. Preferred coagulation baths are maintained at temperatures of 0–28° C., more preferably 10–25° C., and are preferably about 60%, 70%, 80%, 90%, or even 100% methylated spirit (ethanol/methanol mixture, preferably about 85% ethanol, 15% methanol), ethanol or methanol. Preferably the coagulation bath contains acid sufficient to neutralize the basic pH of the dope. In a preferred embodiment, the coagulation bath is 89:10:1 in methylated spirit:water:acetic acid. In an alternate embodiment, coagulation baths contain aluminum sulfate, ammonium sulfate, or sodium sulfate, preferably also contains acid, such as, but not limited to, sulfuric acid. Certain coagulant baths may be preferred depending upon the composition of the dope solution. For example, ethanol and salt based coagulant baths are preferred for an aqueous dope solution. In certain embodiments, surfactants such as nonionic detergents are added to reduce surface tension of the coagulant bath. Residence ("curing") times in coagulation baths can range from nearly instantaneous to several hours, with preferred residence times lasting under one minute, and more preferred residence times lasting about 20 to 30 seconds. In an alternate embodiment, the residence time is 6 hours, 12 hours, or up to 24 hours. Residence times can depend on the geometry of the extruded fiber or filament. In certain embodiments, the extruded biofilament or fiber is passed through more than one coagulation bath of different or same composition. Optionally, the biofilament or fiber is also passed through one or more rinse baths to wash the biofilament or fiber. Typically, rinsing does not follow an alcohol coagulation bath because the alcohol evaporates. Rinse baths of decreasing salt concentration up to, preferably, an ultimate water bath, preferably follow salt baths.

Following extrusion, the biofilament or fiber can be drawn. Drawing can improve the axial orientation and toughness of the biofilament. Optionally, the biofilament or fiber is extruded and treated in one or more coagulation baths prior to drawing. Drawing can be enhanced by the composition of a coagulation bath. Drawing may also be performed in a drawing bath containing a plasticizer such as water, glycerol or a salt solution. Drawing rates depend on the biofilament being processed and typically depend on the extrusion rates. When extruding at about 1 m/min the drawing rate is 3–30 m/min. In one embodiment the drawing rate is 30× the speed of extrusion. Winding rates can range from 0.3 to 30 m/min, preferably about 0.6 to 24 m/min, more preferably 1.2 to 18 m/min, most preferably 1.8 to 12 m/min. In another embodiment, the drawing speed is preferably about 5× the rate of winding.

In certain embodiments of the invention, the biofilament is wound onto a spool after extrusion. Optionally, the biofilament or fiber is treated in one or more coagulation and rinse baths after extrusion and prior to winding. In other embodiments, the biofilament or fiber is extruded, Winding rates are generally 0.4 to 1.0 m/min, preferably 0.7 to 0.9 m/min.

In other embodiments, to enhance the ease with which the fiber is processed, the biofilament can be coated with lubricants or finishes prior to winding. Suitable lubricants or finishes can be polymers or wax finishes including but not limited to mineral oil, fatty acids, isobutyl-stearate, tallow fatty acid 2-ethylhexyl ester, polyol carboxylic acid ester, coconut oil fatty acid ester of glycerol, alkoxylated glycerol, a silicone, dimethyl polysiloxane, a polyalkylene glycol, polyethylene oxide, and a propylene oxide copolymer. It is also contemplated that the lubricants or finishes could also be added to the dope solution.

The spun fibers produced by the methods of the present invention may possess a diverse range of physical properties and characteristics, dependent upon the initial properties of the source materials, i.e., the dope solution, and the coordination and selection of variable aspects of the present method practiced to achieve a desired final product, whether that product be a soft, sticky, pliable matrix conducive to cellular growth in a medical application or a load-bearing, resilient fiber, such as fishing line or cable. The tensile strength of biofilaments spun by the methods of the present invention generally range from 0.03 g/d to 10 g/d, with biofilaments intended for load-bearing uses preferably demonstrating a tensile strength of at least 2 g/d. Such properties as elasticity and elongation at break vary dependent upon the intended use of the spun fiber, but elasticity is preferably 3–4% or more, and elasticity for uses in which elasticity is a critical dimension, e.g., for products capable of being "tied," such as with sutures or laces, is preferably 10% or more. Water retention of spun fibers preferably is close to that of natural silk fibers, i.e., 11%. The diameter of spun fibers can span a broad range, dependent on the application; preferred fiber diameters range from 5, 10, 20, 30, 40, 50, 60 microns, but substantially thicker fibers may be produced, particularly for industrial applications (e.g., cable). The cross-sectional characteristics of spun fibers may vary; e.g., preferable spun fibers include circular cross-sections, elliptical, starburst cross-sections, and spun fibers featuring distinct core/sheath sections, as well as hollow fibers.

The fibers of the invention can be used in such embodiments as in the manufacture of medical devices such as sutures, medical adhesive strips, skin grafts, replacement ligaments, and surgical mesh; and in a wide range of industrial and commercial products, such as fishing line, netting, clothing fabric, bullet-proof vest lining, container fabric, backpacks, knapsacks, bag or purse straps, cable, rope, adhesive binding material, non-adhesive binding material, strapping material, tent fabric, tarpaulins, sheets, pool covers, vehicle covers, fencing material, sealant, construction material, weatherproofing material, flexible partition material, sports equipment; and, in fact, in nearly any use of fiber or fabric for which high tensile strength and elasticity are desired characteristics. Adaptability and use of the stable fiber product in other forms, such as a dry spray coating, bead-like particles, or use in a mixture with other compositions is also contemplated by the present invention.

3.1. Definitions of Terms

By "dope solution" is meant any liquid mixture that contains silk protein and is amenable to extrusion for the formation of a biofilament or film casting. Dope solutions may also contain, in addition to protein monomers, higher order aggregates including, for example, dimers, trimers, and tetramers. Normally, dope solutions are aqueous solutions of pH 4.0–12.0 and having less than 40% organics or chaotropic agents (w/v). Preferably, the dope solutions do not contain any organic solvents or chaotropic agents, yet may include additives to enhance preservation, stability, or workability of the solution. Dope solutions may be made by purifying and concentrating a biological fluid from a transgenic organism that expresses a recombinant silk protein, e.g., U.S. patent application Ser. No. 10/341,097, entitled Recovery of Biofilament Proteins from Biological Fluids, filed Jan. 13, 2003, which is herein incorporated by reference in its entirety. Suitable biological fluids include, for example, cell culture media, milk, urine, or blood from a transgenic mammal, and exudates or extracts from transgenic plants.

By "filament" is meant a fiber of indefinite length, ranging from microscopic length to lengths of a mile or greater. Silk is a natural filament, while nylon and polyester are synthetic filaments.

By "biofilament" is meant a filament created (e.g., spun) from a protein, including recombinantly produced spider silk protein.

By "plasticizer" is meant a chemical added to polymers and resins to impart flexibility or stretchability, or a bonding agent that acts by solvent action on fibers. Water may act as a plasticizer, and a plasticizer means other substances which, owing to their intrinsic characteristics or by aiding in water retention, improve the ductility and plasticity of a fiber.

"Toughness" refers to the energy needed to break the fiber. This is the area under the force elongation curve, sometimes referred to as "energy to break" or work to rupture.

"Elasticity" refers to the property of a body which tends to recover its original size and shape after deformation. Plasticity, deformation without recovery, is the opposite of elasticity. On a molecular configuration of the textile fiber, recoverable or elastic deformation is possible by stretching (reorientation) of inter-atomic and inter-molecular structural bonds. Conversely, breaking and re-forming of intermolecular bonds into new stabilized positions causes non-recoverable or plastic deformations.

"Extension" refers to an increase in length expressed as a percentage or fraction of the initial length.

By "fineness" is meant the mean diameter of a fiber or filament (e.g., a biofilament), which is usually expressed in microns (micrometers).

By "micro fiber" is meant a filament having a fineness of less than 1 denier.

"Modulus" refers to the ratio of load to corresponding strain for a fiber, yarn, or fabric.

"Orientation," when referring to the molecular structure of a filament or the arrangement of filaments within a thread or yarn, describes the degree of parallelism of components relative to the main axis of the structure. A high degree of orientation in a thread or yarn is usually the result of a combing or attenuating action of the filament assemblies. Orientation in a fiber is the result of shear flow elongation of molecules.

"Spinning" refers to the process of making filament or fiber by extrusion of a fiber forming substance, drawing, twisting, or winding fibrous substances.

"Tenacity" or "tensile strength" refers to the amount of weight a filament can bear before breaking. The maximum specific stress that is developed is usually in the filament, yarn or fabric by a tensile test to break the materials.

By "substantially pure" is meant substantially free from other biological molecules such as other proteins, lipids, carbohydrates, and nucleic acids. Typically, a dope solution is substantially pure when at least 60%, more preferably at least 75%, even more preferably 85%, most preferably 95%, or even 99% of the protein in solution is silk protein, on a wet weight or a dry weight basis. Further, a dope solution is substantially pure when proteins account for at least 60%, more preferably at least 75%, even more preferably 85%, most preferably 95%, or even 99% by weight of the organic molecules in solution.

4. BRIEF DESCRIPTION OF THE DRAWINGS

FIG. 1 is a schematic illustration of a spinning apparatus for producing biofilaments from an aqueous solution of spider silk protein. Section A: computer control console. Section B: extrusion unit including a spinneret. Section C: coagulation bath, washing unit and drawing apparatus. Section D: drying unit and post-spinning processing. Section E: winding unit.

FIG. 6 is the amino acid sequence of a representative MaSpI protein which may be spun into biofilaments according to the methods of the invention. The sequence is arranged so that the amino acid repeat motifs can be observed.

FIG. 7 is the amino acid sequence of a representative MaSpII protein which may be spun into biofilaments according to the methods of the invention. The sequence is arranged so that the amino acid repeat motifs can be observed.

FIG. 8 is the amino sequence of a representative ADF-3 protein which may be spun into biofilaments according to the methods of the invention. The sequence is arranged so that the amino acid repeat motifs can be observed.

5. DETAILED DESCRIPTION

Figure 1:
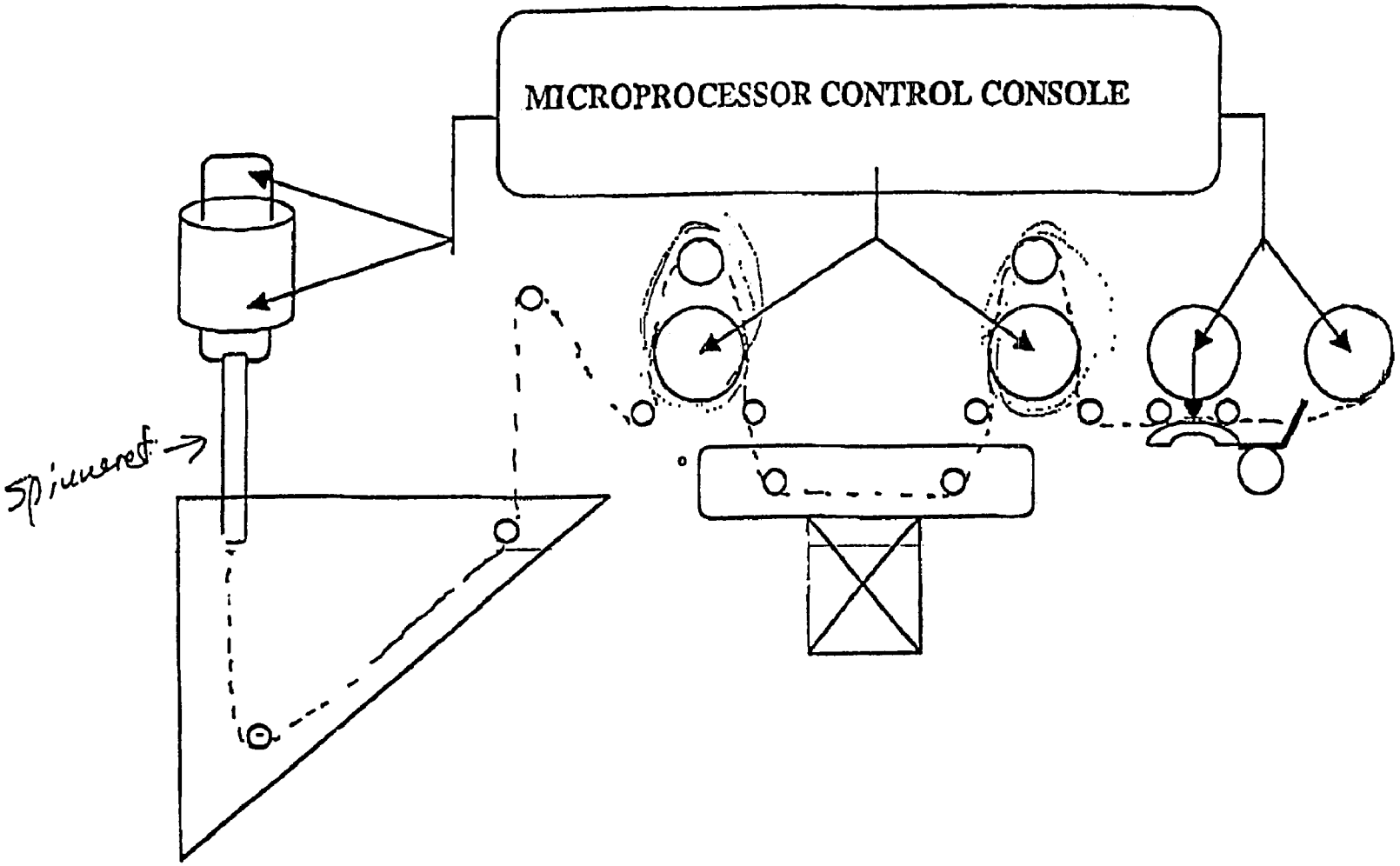
Figure 2:
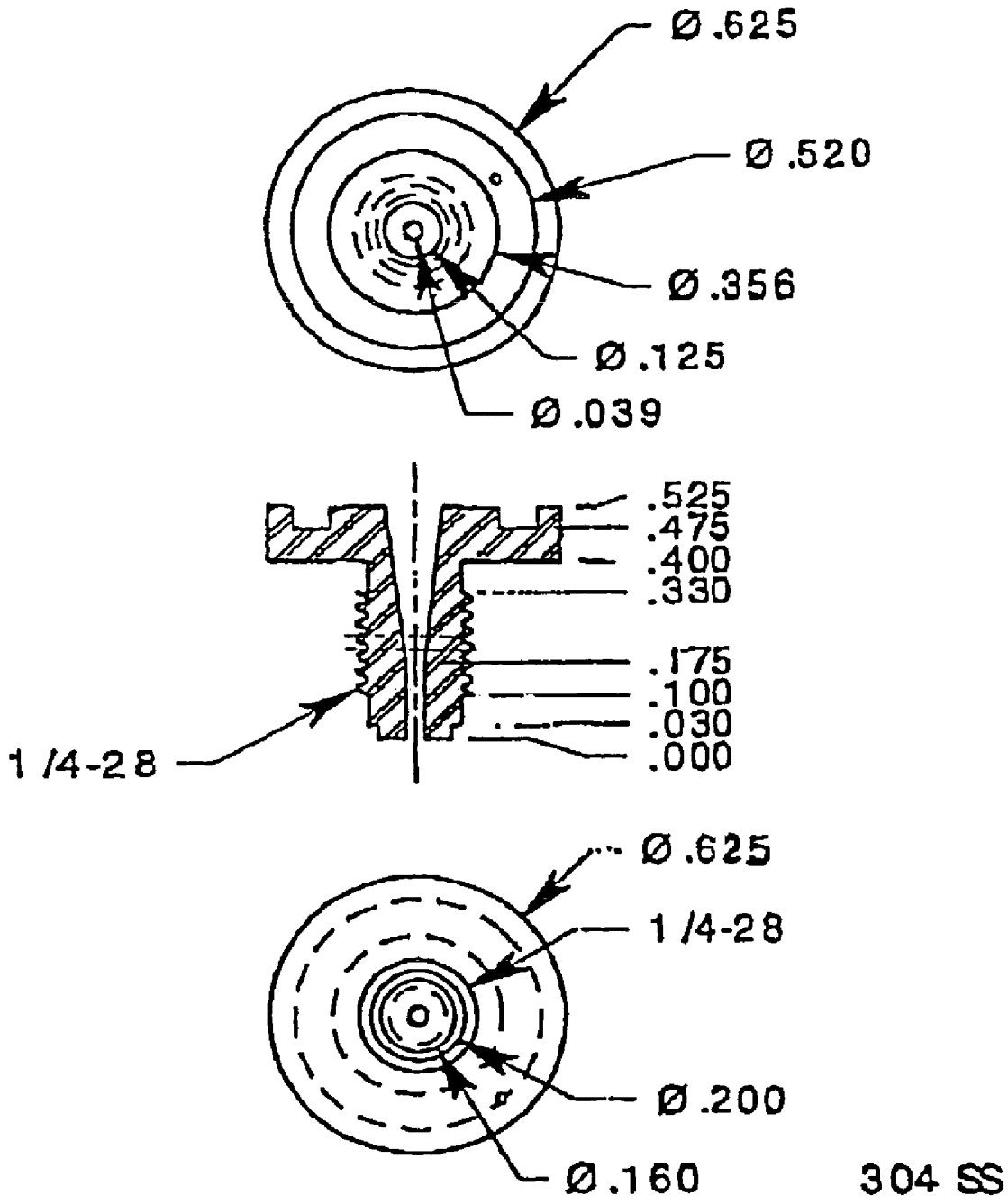
FIG. 2 is a schematic illustration of a spinneret used to extrude spider silk protein.

The present invention provides methods of drawing and spinning fibers from a (viscous liquid) dope solution source. The fibers of the invention are created by extrusion, the process of forcing the dope solution through the small hole of a spinneret. The process forms a continuous filament of semi-solid polymer, and the resulting filament is then solidified, usually by drying (dry spining) or in a coagulation solution (wet spinning). The filament may then be stretched or drawn to impart further strength and toughness through molecular aligmnent.

The properties of a biofilament can be altered at several stages of production. Additives can be incorporated directly into the polymer filament by adulterating the dope solution prior to spinning. Particularly useful additives include viscosity enhancers, such as polyethylene oxide, osmoprotective and stabilizing agents, as well as UV inhibitors, and antimicrobial agents. Once spun, the biofilament can also be coated with modifiers. These coating agents can impart water or microbial resistance, or can include therapeutic agents if the biofilament is being used for medical purposes, for example.

5.1. Filament Production Using Wet Spinning and an Air-Gap

Wet spinning provides significant advantages over melt spinning because numerous useful polymers thermally degrade when heated. Wet spun filaments are formed by forcing the viscous dope through tiny holes in a spinneret plate. The dope solvent is extracted or leached from the extruded filament by another liquid (coagulation bath). In certain embodiments, the coagulation bath also causes a type of "skin" to form on the filament almost immediately, which almost completely prevents the filament from fusing or sticking together.

The dope solution is oriented by a stretching motion during extrusion. This molecular orientation is quickly lost, presumably by Brownian motion, once the stretching is stopped. In particular embodiments of the invention, therefore, during the spinning process, the filaments are first extruded into a coagulation bath through an air gap. In the air gap the filaments undergo two to three times the strain (x-fold extension), which produces a high degree of molecular orientation, and then they are rapidly quenched in the coagulation bath, locking in the molecular orientation. This air gap is generally of the order of one inch, which also allows independent temperature control of the spinneret and the extraction bath.

Uniformity of molecular orientation is a critical determinant of the filament strength. For filaments of large diameter, the core of the filament may lose its orientation, because the quench time to reach the core increases with the square of the filament radius. The filament skin will have a high degree of molecular orientation locked in. This produces a "skin-core" effect, in which the average tensile strength of a filament, per unit cross-sectional area, will decline with increasing filament diameter.

5.2. Spider Silk Proteins Suitable for Spinning

Spider silk proteins are designated according to the gland or organ of the spider in which they are produced. Spider silks known to exist include major ampullate (MaSp), minor ampullate (MiSp), flagelliform (Flag), tubuliform, aggregate, aciniform, and pyriform spider silk proteins. Spider silk proteins derived from each organ are generally distinguishable from those derived from other synthetic organs by virtue of their physical and chemical properties. For example, major ampullate silk, or dragline silk, is extremely tough. Minor ampullate silk, used in web construction, has high tensile strength. An orb-web's capture spiral, in part composed of flagelliform silk, is elastic and can triple in length before breaking. Gosline, et al., J. Exp. Biol. 202: 3295, 1999. Tubuliform silk is used in the outer layers of egg-sacs, whereas aciniform silk is involved in wrapping prey and pyriform silk is laid down as the attachment disk.

The biofilament proteins which may be spun into filaments according to the methods of the present invention may be any recombinantly produced spider silk protein, including recombinantly produced major ampullate, minor ampullate, flagelliform, tubuliform, aggregate, aciniform and pyriform proteins. These proteins may be any type of biofilament proteins such as those produced by a variety of arachnids, including, but not limited to *Nephilla clavipes, Arhaneus* ssp. and *A. diadematus*. Also suitable for use in the invention are proteins produced by insects such as *Bombyx mori*. Dragline silk produced by the major ampullate gland of *Nephilia clavipes* occurs naturally as a mixture of at least two proteins, designated as MaSpI and MaSpII. Similarly, dragline silk produced by A. diadematus is also composed of a mixture of two proteins, designated ADF-3 and ADF-4.

The biofilament proteins spun according to the invention may be monomeric proteins, fragments thereof, or dimers, trimers, tetramers or other multimers of a monomeric protein. The biofilament proteins are encoded by nucleic acids, which can be joined to a variety of expression control elements, including tissue-specific animal or plant promotors, enhancers, secretory signal sequences and terminators. These expression control sequences, in addition to being adaptable to the expression of a variety of gene products, afford a level of control over the timing and extent of production.

Sequencing of spider silk proteins has revealed that these proteins are dominated by iterations of four simple amino acid motifs: (1) polyalanine $(Ala_n)$; (2) alternating glycine and alanine $(GlyAla)_n$; (3) GlyGlyXaa; and (4) GlyProGly $(Xaa)_n$, where Xaa represents a small subset of amino acids, including Ala, Tyr, Leu and Gln (for example, in the case of the GlyProGlyXaaXaa motif, GlyProGlyGlnGln is the major form). Hayashi, et al., J. Mol. Biol. 275:773, 1998; Hinman, et al, Trends in Biotech. 18:374–379, 2000. Spider silk proteins may also contain spacers or linker regions comprising charged groups or other motifs, which separate the iterated peptide motifs into clusters or modules.

Modules of the GlyProGly$(Xaa)_n$ motif are believed to form a β-turn spiral structure which imparts elasticity to the protein. Major ampullate and flagelliform silks both have a GlyProGlyXaaXaa motif and are the only silks which have elasticity greater than 5–10%. Major ampullate silk, which has an elasticity of about 35%, contains an average of about five β-turns in a row, while flagelliform silk, which has an elasticity of greater than 200%, has this same module repeated about 50 times. The polyalanine $(Ala_n)$ and $(GlyAla)_n$ motifs form a crystalline β sheet structure which provides strength to the proteins. The major ampullate and minor ampullate silks are both very strong, and at least one protein in each of these silks contains a $(Ala_n)/(GlyAla)_n$ module. The GlyGlyXaa motif is associated with a helical structure having three amino acids per turn ($3_{10}$ helix), and is found in most spider silks. The GlyGlyXaa motif may provide additional elastic properties to the silk.

The methods of the present invention are applicable to spinning of biofilament proteins which comprise the above-mentioned motifs. In particular, the methods of the invention encompass spinning biofilament proteins having a sequence that is substantially identical to a sequence selected from the group consisting of:

AlaAlaAlaAlaAla
GlyAlaGlyAla
GlyAlaGlyAlaGlyAla
GlyAlaGlyAlaGlyAlaGlyAla
GlyAlaGlyAlaGlyAlaGlyAlaGlyAla
GlyAlaGlyAlaGlyAlaGlyAlaGlyAlaGlyAla
GlyAlaGlyAlaGlyAlaGlyAlaGlyAlaGlyAlaGlyAla
GlyGlyTyrGlyGlnGlyTyr

AlaAlaAlaAlaAlaAlaAlaAla
GlyGlyAlaGlyGlnGlyGlyTyr
GlyGlyGlnGlyGlyGlnGlyGlyTyrGlyGlyLeuGlySerGlnGlyAla
AlaSerAlaAlaAlaAlaAlaAla
GlyProGlyGlnGln
$(GlyProGlyGlnGln)_2$
$(GlyProGlyGlnGln)_3$
$(GlyProGlyGlnGln)_4$
$(GlyProGlyGlnGln)_5$
$(GlyProGlyGlnGln)_6$
$(GlyProGlyGlnGln)_7$
$(GlyProGlyGlnGln)_8$
GlyProGlyGlyGlnGlyGlyProTyrGlyProGly
SerSerAlaAlaAlaAlaAlaAlaAlaAla
GlyProGlySerGlnGlyProSer
GlyProGlyGlyTyr

Preferably, the biofilament protein has a C-terminal portion with an amino acid sequence repeat motif which is from about 20–40 amino acids in length, more preferably 34 amino acids in length, and a consensus sequence which is from about 35–55 amino acids in length, more preferably, 47 amino acids in length. Preferably, the biofilament protein has an amino acid repeat motif (creating both an amorphous domain and a crystal-forming domain) having a sequence that is at least about 50% identical more preferably, at least about 70% identical, and most preferably at least about 90% identical to: Ala Gly Gln Gly Gly Tyr Gly Gly Leu Gly Ser Gln Gly Ala Gly Arg Gly Gly Leu Gly Gly Gln Gly Ala Gly Ala Ala Ala Ala Ala Ala Ala Gly Gly (SEQ ID NO: 1), as may be found in *Nephila* spidroin I (MaSpI) proteins. In another embodiment, it is preferred that the biofilament protein has a consensus structure that is at least about 50% identical, more preferably, at least about 70% identical, and most preferably at least about 90% identical to: Cys Pro Gly Gly Tyr Gly Pro Gly Gln Gln Cys Pro Gly Gly Tyr Gly Pro Gly Gln Gln Cys Pro Gly Gly Tyr Gly Pro Gly Gln Gln Gly Pro Ser Gly Pro Gly Ser Ala Ala Ala Ala Ala Ala Ala Ala Ala Ala (SEQ ID NO:2), as may be found in the Nephila spidroin 2 (MaSpII) proteins. Preferably, the biofilament protein, when subjected to shear forces and mechanical extension, has a polyalanine segment that undergoes a helix to a β-sheet transition, where the transition forms a β-sheet that stabilizes the structure of the protein. It is also preferred that the biofilament has an amorphous domain that forms a β-pleated sheet such the inter-β sheet spacings are between 3 and 8 angstroms; preferably between 3.5 and 7.5 angstroms.

The biofilament proteins which are applicable to the methods of the present invention include recombinantly produced MaSpI and MaSpII proteins, as described in U.S. Pat. Nos. 5,989,894 and 5,728,810 (hereby incorporated by reference). These patents disclose partial cDNA clones of spider silk proteins MaSpI and MaSpII, and the amino acid sequences corresponding thereto. The MaSpI and MaSpII spider silk or fragment or variant thereof usually has a molecular weight of at least about 16,000 daltons, preferably 16,000 to 100,000 daltons, more preferably 50,000 to 80,000 daltons for fragments and greater than 100,000 but less than 300,000 daltons, preferably 120,000 to 300,000 daltons for the full-length protein.

The methods of the invention are also applicable to minor ampullate spider silk proteins, such as those disclosed in U.S. Pat. Nos. 5,756,677 and 5,733,771, and to flagelliform silks, such as those described in U.S. Pat. No. 5,994,099, and spider silk proteins described in U.S. Provisional Patent Application No. 60/315,529. These patents and applications are hereby incorporated by reference.

The sequences of the spider silk proteins may have amino acid inserts or terminal additions, so long as the protein retains the desired physical characteristics. Likewise, some of the amino acid sequences may be deleted from the protein so long as the protein retains the desired physical characteristics. Amino acid substitutions may also be made in the sequences, so long as the protein possesses or retains the desired physical characteristics.

Figure 5:
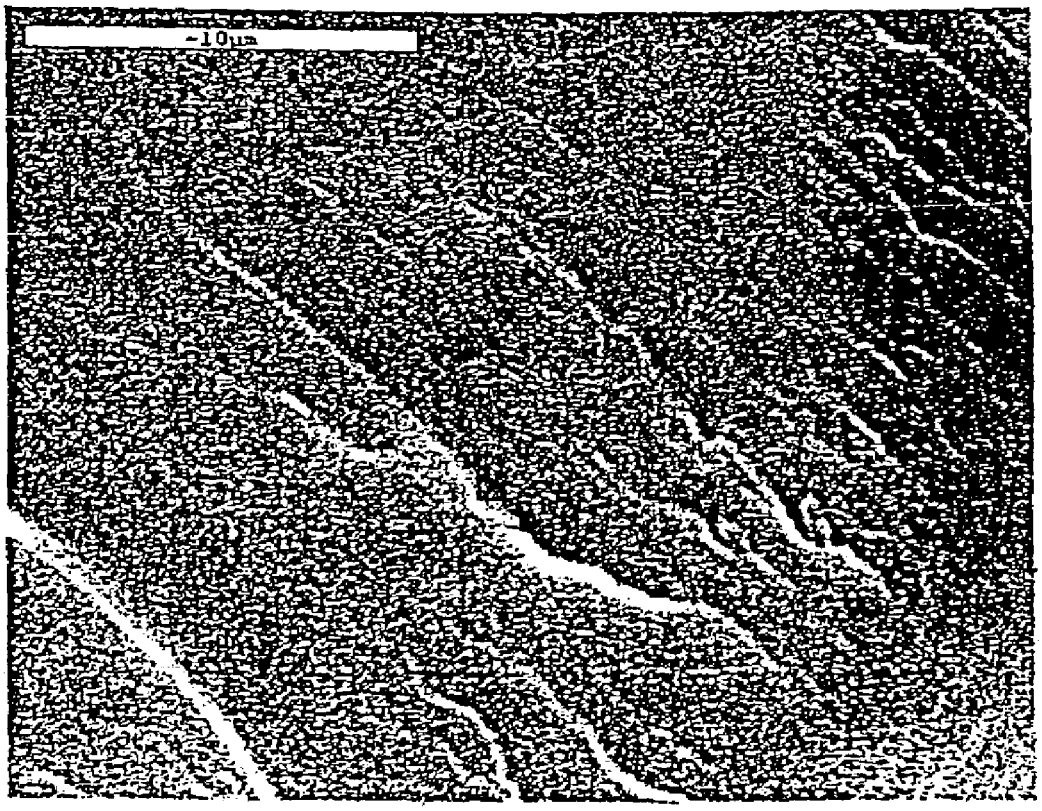
FIG. 5 is a scanning electron micrograph showing recombinant spider silk fiber fractures.

Examples of recombinantly produced MaSpI and MaSpII proteins which may be spun according to the methods of the invention are depicted in FIGS. 5 and 6, respectively. FIG. 5 shows the sequence of a representative MaSpI protein arranged so that the amino acid repeat motifs can be seen. FIG. 6 shows the sequence of a representative MaSpII protein, arranged so that the amino acid repeat motifs can be seen.

The methods of the invention may also be used to recover recombinantly produced ADF-1, ADF-2, ADF-3 and ADF-4 proteins from biological fluids. These proteins are produced naturally by the *Araneus diadematus* species of spider. The ADF-1 generally comprises 68% $poly(Ala)_5$ or $(GlyAla)_{2-7}$, and 32% GlyGlyTyrGlyGlnGlyTyr (SEQ ID NO: 10). The ADF-2 protein generally comprises 19% $poly(A)_8$, and 81% GlyGlyAlaGlyGlnGlyGlyTyr (SEQ ID NO: 12) and GlyGlyGlnGlyGlyGlnGlyGlyTyrGlyGlyLeuGlySerGlnGlyAla (SEQ ID NO: 13). The ADF-3 protein generally comprises 21% AlaSerAlaAlaAlaAlaAlaAla (SEQ ID NO: 14) and 79% (GlyProGlyGlnGln)n, where n=1–8. The ADF-4 protein comprises 27% SerSerAlaAlaAlaAlaAlaAlaAlaAla (SEQ ID NO: 24) and 73% GlyProGlySerGlnGlyProSer (SEQ ID NO: 25) and GlyProGlyGlyTyr (SEQ ID NO: 26). An example of a recombinantly produced ADF-3 protein which may be recovered according to the methods of the invention is depicted in FIG. 7, which shows the sequence of a representative ADF-3 protein, arranged so that the amino acid repeat motifs can be seen.

In alternate embodiments, the methods of the invention are applicable to spinning mixtures of biofilament proteins and one or more synthetic polymers or natural or synthetic biofilament proteins. The different proteins and polymers can be combined prior in the dope solution or combined post-extrusion. In preferred embodiments, high performance fibers and/or elements can be combined with spider silk proteins in the dope solution or post-extrusion. Examples include, but are not limited to, fibers of animal or plant origin, such as wool, silk other than spider silk, collagen, and cellulosics, or synthetic fibers such as poyolefin fibers, polyesters, polyamides (i.e., nylons), fibers from liquid crystalline polymers (e.g., aramids), polyoxymethylene, polyacrylics (i.e., polyacrylonitrile), poly(phenylene sulfide), poly(vinyl alcohol), poly(ether ether ketone) (i.e., PEEK), poly[2,2'-(m-phenylene)-5,5'-bibenzimidazole] (i.e., PBI), poly(blycolic acid), poly(glycolic acid-co-L-lactic acid, and poly(L-lactide), aromatic polyhydrazides, aromatic polyazomethines, aromatic polyimides, poly (butene-1), polycarbonate, polystyrene, and polytetrafluoroethylene. Such combinations preferably allow for enhancement of certain desired fiber properties.

Abbreviations for amino acids used herein are conventionally defined as described herein below unless otherwise indicated.

| Amino Acid | Three-letter abbreviation | One-letter Symbol |
|---|---|---|
| Alanine | Ala | A |
| Arginine | Arg | R |
| Asparagine | Asn | N |
| Aspartic Acid | Asp | D |
| Asparagine or aspartic acid | Asx | B |
| Cysteine | Cys | C |
| Glutamine | Gln | Q |
| Glutamic acid | Glu | E |
| Glutamine or glutamic acid | Glx | Z |
| Glycine | Gly | G |
| Histidine | His | H |
| Leucine | Leu | L |
| Lysine | Lys | K |
| Methionine | Met | M |
| Phenylalanine | Phe | F |
| Proline | Pro | P |
| Serine | Ser | S |
| Threonine | Thr | T |
| Tryptophan | Trp | W |
| Tyrosine | Tyr | Y |
| Valine | Val | V |

5.3. Transgenic Animals

Silk proteins suitable for spinning into filaments according to the methods of the invention, may be extracted from mixtures comprising biological fluids produced by transgenic animals, preferably transgenic mammals, most preferably transgenic goats. Transgenic animals useful in the invention are animals that have been genetically modified to secrete a target biofilament in, for example, their milk or urine. The methods of the invention are applicable to biological fluids from any transgenic animal capable of producing a recombinant biofilament protein. Preferably, the biological fluid is milk, urine, saliva, seminal fluid, sweat, tears, or blood derived from a transgenic mammal. Preferred mammals are rodents, such as rats and mice, or ruminants, such as goats, cows, sheep, and pigs. Most preferably, the animal is a goat (see e.g., U.S. Pat. No. 5,907,080). The transgenic animals useful in the invention may be produced as described in PCT publication no. WO 99/47661 and U.S. patent publication Ser. No. 20010042255, incorporated herein by reference. The biological fluids produced by the transgenic animals may be purified, clarified, and concentrated, through such techniques as, e.g., tangential flow filtration, salt-induced precipitation, acid precipitation, EDTA-induced precipitation, and chromatographic techniques, including expanded bed absorption chromatography (see e.g., U.S. patent application Ser. No. 10/341,097, entitled Recovery of Biofilament Proteins from Biological Fluids, filed Jan. 13, 2003, incorporated herein by reference).

5.4. Cell Culture Media

The methods of the present invention are also applicable to biofilament proteins derived from conditioned media recovered from eukaryotic cell cultures, preferably mammalian cell cultures, which have been engineered to produce the desired biofilaments as secreted proteins. Cell lines capable of producing the subject proteins can be obtained by cDNA cloning, or by the cloning of genomic DNA, or a fragment thereof, from a desired cell as described by Sambrook, J., et al., Molecular Cloning: A Laboratory Manual, 3d Ed., Cold Spring Harbor Laboratory Press (2001). Examples of mammalian cell lines useful for the practice of the invention include, but are not limited to BHK (baby hamster kidney cells), CHO (Chinese hamster ovary cells) and MAC-T (mammary epithelial cells from cows).

5.5. Plant Sources

The methods of the invention can also be applied to biofilaments originating from mixtures comprising plant extracts. Several methods are known in the art by which to engineer plant cells to produce and secrete a variety of heterologous polypeptides. See, for example, Esaka et al., Phytochem. 28:2655–2658, 1989; Esaka et al., Physiologia Plantarum 92:90–96, 1994; Esaka et al, Plant Cell Physiol. 36:441–446, 1995, and Li et al., Plant Physiol. 114:1103–1111. Transgenic plants have also been generated to produce spider silk. Scheller et al., Nature Biotech. 19:573, 2001; PCT publication WO 01/94393 A2.

Exudates produced by whole plants or plant parts may be used in the methods of the present invention. The plant portions for use in the invention are intact and living plant structures. These plants materials may be a distinct plant structure, such as shoots, roots or leaves. Alternatively, the plant portions may be part or all of a plant organ or tissue, provided the material contains or produces the biofilament protein to be recovered.

Having been externalized by the plant or the plant portion, exudates are readily obtained by any conventional method, including intermittent or continuous bathing of the plant or plant portion (whether isolated or part of an intact plant) with fluids. Preferably, exudates are obtained by contacting the plant or portion with an aqueous solution such as a growth medium or water. The fluid-exudate admixture may then be subjected to the purification methods of the present invention to obtain the desired biofilament protein. The proteins may be recovered directly from a collected exudate, preferably guttation fluid, or a plant or a portion thereof.

Extracts useful in the invention may be derived from any transgenic plant capable of producing a recombinant biofilament protein. Preferred for use in the methods of the present invention are plant species representing different plant families, including, but not limited to, monocots such as ryegrass, alfalfa, turfgrass, eelgrass, duckweed and wilgeon grass; dicots such as tobacco, tomato, rapeseed, azolla, floating rice, water hyacinth, and any of the flowering plants. Other preferred plants are aquatic plants capable of vegetative multiplication such as Lemna and other duckweeds that grow submerged in water, such as eelgrass and wilgeon grass. Water-based cultivation methods such as hydroponics or aeroponics are useful for growing the transgenic plants of interest, especially when the silk protein is secreted from the plant's roots into the hydroponic medium from which the protein is recovered.

The plant used in the present invention may be a mature plant, an immature plant such as a seedling, or a plant germinating from seed. According to the methods of the invention, the recombinant polypeptide is recovered from an exudate of the plant, which may be a root exudate, guttation fluid oozing from the plant via leaf hydathodes, or other sources of exudate, independent of xylem pressure. The proteins may be exited or oozed out of a plant as a result of xylem pressure, diffusion or facilitated transport (i.e., secretion).

5.6. The Dope Solution

The dope solution used in the methods of the present invention is a solution of recombinant spider silk protein. The solvent used for the dope solution of the present invention can be any aqueous solution in which the spider silk protein is soluble; however, it is preferred that the solvent is an aqueous buffer solution with a pH from about 4 to about 12, preferably a pH about 11, (e.g., pH 10.6–11.3).

In a specific embodiment, the dope solution does not contain solubilizing agents such as hexafluoroisopropanol and other organic solvents, or guanidine hydrochloride, urea or other denaturants or chaotropic agents. Aqueous buffers that promote a liquid crystalline structure of the spider silk protein are most preferable and result in fibers with the best structural properties. A preferred buffer solution for use in the dope solutions of the present invention is 50 mM glycine. Other useful buffers include, but are not limited to, PBS (phosphate buffered saline), Tris (Tris hydroxymethylaminoethane), pyrrolidine, piperidine, dialkylamines (e.g., diethylamine), homocysteine, cysteine, 6-aminohexanoic acid, CABS (N-cyclohexyl-4-aminobutane-1-sulfonic acid), 4-aminobutyric acid, proline, threonine, CAPS (N-cyclohexyl-3-aminopropane-1-sulfonic acid), β-alanine (3-aminopropanoic acid), lysine, ascorbate, trialkylamines (e.g., triethylamine), cysteic acid, and carbonate.

In an alternate embodiment, the dope solution comprises spider silk protein dissolved in one or more non-aqueous solvents or comprises spider silk proteins.

Normally, the dope solution is about 2–40% (w/v) in spider silk protein. Preferably, the dope is about 15–25% (w/v) spider silk protein, but most preferably about 20% (w/v). The concentration of the dope solution should be high enough to maintain the spider silk protein in a form suitable for spinning, but low enough to avoid gelling and precipitation of the protein. Typically, concentrations in excess of 15% (w/v) spider silk protein are necessary to achieve the form suitable for spinning; however, at concentrations above 40%, formation of insoluble aggregates and/or disoriented spider silk fibers may occur. The presence of these aggregates and misaligned fibers in the dope solution results in the production of a poor quality biofilament, making the biofilaments more susceptible to breakage. Adjusting the pH of the dope solution to about pH 11 (e.g., pH 10.6–11.3) reduces the aggregate formation and results in fibers of higher quality that are more resistant to breakage. In one embodiment, the pH of the dope is adjusted by adding glycine.

The dope solution may also contain various additives to improve the stability and physical properties (e.g., viscosity) of the dope solution, enhance the fiber spinning process and improve the quality of the resulting fibers. These additives may be used to increase the stability of the dope or increase the crystallinity of the spider silk protein in solution. Such additives may allow for the spinning of high quality biofilaments from dope solutions that are about 45%, 50%, 60% or more (w/v) silk protein. Additionally, additives that enhance the solubility of the spider silk protein are also useful as they may allow spinning of more concentrated dope solutions. Dope solution additives may also become incorporated into the spun spider silk fibers (biofilaments). Typical additives of this type include, for example, plasticizers which enhance the water retention in the spun fiber. An especially preferable additive, polyethylene oxide, having a molecular weight in the range of 4,000,000–6,000,000, can perform as a viscosity enhancer, promote stability and processability of the dope solution, serve as an inhibitor of dope gelation, and/or facilitate adaptability of the dope to dry spinning, i.e., extrusion directly into air and to the steps of drawing and spinning, without immersion in a coagulation bath or wash. In one embodiment, polyethylene oxide, preferably having a molecular weight of 4,000,000 to 6,000,000 is added to the dope solution in concentrations of 0.03 to 2%. In another embodiment, polyethylene oxide having a molecular weight ranging from 4,000,000 to 9,000,000, or greater than 10,000,000 if dissolvable in the aqueous solution is added at concentrations wherein which the polyethylene oxide retains the ability to dissolve into the dope solution. The higher the molecular weights of the polymer, the lower the concentration that can be used. Preferably, the ratio of silk protein to polymer in the dope solution is no greater than 100:1. If necessary, additives may be removed from a fiber or filament in the coagulation bath or as a result of washing the spun fiber.

Additives may include compounds present in the aqueous dopes that are naturally secreted by spiders such as, for example, GABamide (γ-aminobutyramide), N-acetyltaurine, choline, betaine, isethionic acid, cysteic acid, lysine, serine, potassium nitrate, potassium dihydrogenphosphate, glycine, and highly saturated fatty acids. Vollrath et al., Nature 345: 526–528, 1990; Vollrath, Reviews in Molecular Biotechnology, 74:67–83, 2000. These naturally occurring additives help maintain the aqueous coating of the capture web and keep the silk proteins in favorable conformations. Thus, the web is stabilized under a variety of conditions and dehydration is prevented. Specifically, betaine and GABamide are osmoprotectives and osmolytes used by a wide range of organisms. Taurine is a protein-stabilizing compound.

Other additives which may be used in the dope solution of the present invention include, but are not limited to, succinamide, morpholine, CHES (N-cyclohexylaminoethane sulfonic acid), ACES (N-(2-acetamido)-2-aminoethane sulfonic acid), 2,2,2-trifluoroethanol, saturated fatty acids such as hexanoic acid and stearic acid, glycerol, ethylene glycol, poly(ethylene glycol), lactic acid, citric acid and 2-mercaptoethylamine.

Other useful additives may be included in the coagulation bath. Additives including certain surfactants, osmoprotective agents, stabilizing agents, UV inhibitors, and antimicrobial agents are effective when added to the dope solution, or to the coagulation bath, or both. Stabilizers that protect against UV radiation, radical formation, and biodegradation include, for example, 2-hydroxybenzophenones, 2-hydroxyphenyl-2-(2H)-benzotriazoles, cifmamates, and mixtures thereof. These chemicals are capable of absorbing and dissipating UV energy, thereby inhibiting UV degradation. Free radicals are neutralized by hindered amine light stabilizers (HALS), butylated hydroxyanisole (BHA), and butylated hydroxytoluene (BHT). Antimicrobials that may be added to the spin dope of the present invention include silver nitrate, iodized radicals (e.g., Triosyn®; Hydro Biotech), benzylalkonium chloride, alkylpyridinium bromide (cetrimide), and alkyltrimethylammonium bromide. Viscosity enhancers may be added to improve the rheological properties of the dope. Examples include, but are not limited to polyacrylates, alginate, cellulosics, guar, starches and derivatives of these polymers, including hydrophobically modified derivatives. In a preferred embodiment, polythylene oxide is added. In one such embodiment, polyethylene oxide, preferably having a molecular weight of 4,000,000 to 6,000,000 is added to the dope solution in concentrations of 0.03 to 2%. In another such embodiment, polyethylene oxide having a molecular weight ranging from 6,000,000 to 9,000,000, or greater than 10,000,000 is added at concentrations wherein which the polyethylene oxide retains the ability to dissolve into the dope solution. Preferably, the ratio of silk protein to polymer in the dope solution is no greater than 100:1.

The dope is normally prepared from a biological fluid derived from a transgenic organism, such as is disclosed in U.S. application Ser. No. 10/341,097, entitled Recovery of Biofilament Proteins from Biological Fluids, filed Jan. 13, 2003, which is hereby incorporated by reference in its entirety. Recombinant spider silk protein used for production of dope can be recovered, for example, from cultures of transgenic mammalian cells, plants, or animals and the dope prepared from culture media, plant extracts, or the blood, urine, or milk of transgenic mammals. Removing contaminating biomolecules (e.g., proteins, lipids, carbohydrates) from the dope, via such methods as tangential flow filtration, centrifugation and filtering, and chromatographic techniques, generally improves the properties of the spun fiber.

According to the methods of the invention, the dope solution is produced and/or used for spinning at a temperature in the range of 0 to 25° C. In a specific embodiment, the dope is produced and/or used at 4° C. In yet another specific embodiment, the dope is produced and/or used at room temperature.

5.7. The Extrusion Unit and Spinneret

In the apparatuses and methods of the present invention, the extrusion unit houses the spinneret through which the dope is passed. The extrusion unit enables control of the dope flow rate and can be regulated by a heating or cooling jacket. The temperature and flow conditions of extrusion will depend upon the specific recombinant spider silk protein or mixture of proteins being spun, and the desired properties of the filament. Preferably, the dope flow is virtually pulse free.

Spinnerets can be tailored to suit specific applications. The spinneret can have a single orifice or multiple orifices, depending on, for example, the volume of dope to be spun, and the number of filaments to be produced. In spinnerets with multiple orifices, a converging constant taper, resulting in a conical or funnel shape, has been shown to facilitate the application of shear stress during spinning to achieve molecular alignment. The diameter of the spinneret opening is preferably about 10–100 μm, but can be 200 μm, 500 μm, 750 μm, or even as large as 1000 μm. The diameter of the spinneret is preferably about 25–150 μm. In one embodiment, the spinneret orifice is larger than the final diameter of the spun filaments. Any length:intemal diameter (L:ID) ratio greater than one can be used. The spinneret may be composed of various materials, including metals and alloys, such as stainless steel or tantalum, polymeric materials, such as PEEK tubing, ceramics or carbon-composite materials. Spinnerets with a single orifice may be made of metal, preferably stainless steel. Spinnerets with multiple orifices are preferably made of polymeric tubing, most preferably PEEK tubing. Spinnerets may also be treated with substances, such as TEFLON® or spray silicon, in such a manner as to prevent adherence of the dope to the spinneret needle.

In a preferred configuration, a small volume adapter is added to the spinneret to facilitate the experimental spinning of as little as 10 μl of dope. The spinneret may be mounted in the coagulation bath at in any orientation at any angle, ranging from vertically up 90° to the horizontal to vertically down 90° to the horizontal and is primarily contingent upon the weight of the dope relative to the coagulant bath. In preferred embodiments, the spinneret is preferably mounted vertically up where the dope is heavier than the coagulant; the spinneret is preferably mounted vertically down where the dope is lighter than the coagulant; the spinneret is preferably mounted horizontally where the dope and coagulant have the same density. In one such specific embodiment, the spinneret is mounted vertically up in a salt-based bath. In another specific embodiment, the spinneret is mounted vertically down in an ethanol-based bath. The spinneret is maintained and is held at temperatures below 100° C., e.g., 0° C., 5° C., 10° C., 15° C., 20° C., 25° C., 30° C., 35° C., 40° C., 50° C., 60° C., 70° C., 80° C., or 90° C., but is preferably maintained at temperatures below 30° C., more preferably in the range of 0–5° C. The spinneret may have a tube length in the range of 1–500 mm. Single-orifice spinneret lengths of about 20, 30, 40, 50, 60, 70, 80, 90, 100, 110, 120 mm are particularly useful, spinneret lengths of about 45–65 mm being highly preferable; while multiple orifice spinnerets tend to feature comparatively shorter tube lengths, preferably with length of about 1, 2, 3, 5 mm, more preferably around 3 mm.

A skilled artisan will be able to design an appropriate spinning apparatus for any particular application. For experimental use, for example, a Harvard Virtual Pulse Free Micro Dialysis Syringe Pump VPF 11 was used to extrude a 1–2.5 mL Hamilton Gastight LC Syringe, preferably a 1 mL syringe, (ID 4.61 mm, length 60 mm) with micro bore polymer spinneret (ID 0.127 mm) containing purified recombinant spider silk protein dope solution into various coagulation baths to spin spider silk filament. The syringe pump was set to deliver the dope at 2–15 μL/min (from 0.4 m/minute, and up to 4 m/minute and, in certain embodiments, 8 to 10 m/minute). This apparatus may be modified for industrial purposes to accommodate larger syringes, more rapid extrusion rates, and/or multi-orifice spinnerets. Alternatively, for industrial use, a system that is more conducive to spinning large amounts of biofilament from larger volumes of dope solution can be designed in view of the principles described herein without departing from the scope of the invention.

5.8. The Coagulation Bath

As an integral aspect of the wet spinning methods of the present invention, coagulation serves to stabilize the molecular orientation of the silk proteins within the biofilament. In alternate embodiments of the invention, the growing filament can be extruded through an air gap before entering a coagulation bath, or the filament can be extruded directly into the coagulation bath. Additionally, the filament may be processed through one or more (e.g., two, three, four or five) coagulation baths, preferably of the same composition, to extend the residence time in the bath, or, in certain embodiments, of sequentially lesser coagulant concentrations, optionally followed by one or more rinse/wash baths. For example, one preferable embodiment of the invention includes processing a filament through a coagulation bath of 50% ammonium sulfate, followed by baths of 25% ammonium sulfate, 12%, 6%, then water. The dimensions of the air gap, and duration of the filament in the air gap, as well as residence time of the filament in the coagulation bath, are considerations that contribute to final filament properties. Preferred air gap dimensions, number of coagulation baths and coagulation bath dimensions, and durations of the filament in the air gap and in coagulation will depend upon the characteristics of the dope, as well as commercial and manufacturing considerations; however, one preferred system includes an air gap of one inch, followed by a residence time under 30 seconds within the coagulation bath. Preferable residence times within the coagulation bath are generally under one minute, although residence times may extend to several hours (e.g., more than 2 hours, more than 6 hours, more than 12 hours, more than 24 hours, more than 48 hours) without negatively impacting the quality of the filament.

In addition to residence time of the biofilament within the coagulation bath, the composition of the coagulation bath itself is an important determinant of the filament's final properties. Suitable coagulation baths contain a solvent such as an methylated spirit (i.e., ethanol/methanol mixture), acetone, or combinations thereof. Particularly useful coagulation baths are aqueous solutions containing greater than 50% methylated spirit. More preferably, the coagulation bath contains about 85–90% methylated spirit. Acids (to neutralize the basic pH of the dope solution), such as acetic acid, sulfuric acid, or phosphoric acid may be added to the alcohol-based coagulation bath. In a preferred embodiment, the coagulation bath comprises 89% methylated spirit (consisting of about 85% ethanol, 15% methanol), 10% water, and 1% glacial acetic acid.

Alternatively, the coagulation bath may be a concentrated aqueous salt solution having a high ionic strength. The high osmotic pressure of a concentrated salt solution draws the water away from the spider silk protein, thereby facilitating filament coagulation. Preferred coagulation baths include aqueous solutions containing a high concentration of aluminum sulfate, ammonium sulfate, sodium sulfate, or magnesium sulfate. Additives, particularly acids, such as acetic acid, sulfuric acid, or phosphoric acid, or also sodium hydroxide may be added to the salt-based coagulation bath.

Preferred concentrated salt coagulation baths of the present invention comprise one or more salts of high solubility such as, for example, salts containing one or more of the following anions: nitrates, acetates, chlorates, halides (fluoride, chloride, bromide, iodide), sulfates, sulfides, sulfites, carbonates, phosphates, hydroxides, thiocyanates, bicarbonates, formates, propionates, and citrates; and one or more of the following cations: ammonium, aluminum, calcium, cesium, potassium, lithium, magnesium, manganese, sodium, nickel, rubidium, antimony, and zinc. The bath may also contain an acid of the same anion as the salt, e.g., nitric, acetic, hydrochloric, sulfuric, carbonic, phosphoric, formic, propionic, citric, or lactic acid, or another acid which also forms highly soluble salts with the cation(s) present. Preferably, the salts used in the coagulation bath of the present invention are multivalent anions and/or cations, resulting in a greater number of ions, and proportionally higher ionic strength, on dissociation. Typically, concentrated salt coagulation baths are about 30%–70% (w/v) of salt; preferably about 40–65%.

Specific examples of acid/salt combinations useful in the coagulation baths of the invention include: mixture of hydrochloric acid with one or more chlorides, such as zinc, calcium, nickel, lithium, aluminum, cesium, ammonium, potassium, and sodium; a mixture of formic acid with potassium formate; a mixture of acetic acid with lithium, potassium, ammonium, sodium or calcium acetate; a mixture of carbonic acid with rubidium carbonate, ammonium carbonate, or cesium bicarbonate; a mixture of nitric acid with manganese, zinc, calcium, ammonium, lithium, sodium or aluminum nitrate; a mixture of phosphoric acid with ammonium or potassium phosphates; a mixture of propionic acid with potassium propionate; and a mixture of sulfuric acid with ammonium, aluminum, sodium or magnesium sulfates. A highly preferable combination is the use of a mixture of ammonium sulfate with sulfuric acid.

5.9. Drawing and Washing

The drawing process improves the axial orientation and toughness of the biofilament. The drawing process can develop end-use properties such as modulus and tenacity. The fibers are stretched or drawn under conditions wherein significant molecular orientation is imparted. The variables include but are not limited to draw ratio, temperature and strain rate. In certain embodiments, the drawing is enhanced by the composition of the coagulation bath. For example, methanol-water mixtures are particularly useful for drawing spider silk proteins.

Drawing is preferably done using a set of godets, with the filament wrapped several times (e.g. 3–8 times) around the chromium roller of each godet. Drawing speeds will depend upon the type of filament being processed; preferred drawing speeds generally range from 3–30 m/min, which is preferably about 5× the rate of extrusion, but may be 3 to 30 times the extrusion rate. Draw ratio is often specified as the ratio of output speed to input speed of the filament and the drawing speed will affect the draw ratio, thereby achieving an desired initial to final cross-sectional area. The higher the draw ratio, the higher the molecular orientation of the fiber.

During the drawing process, the filament may be plasticized by residual or fresh solvent, or softened by the application of heat, preferably by steam. There may be a plurality of washing baths containing a solution that plasticizes the filament. Water, for example, is a useful plasticizer of spider silk filaments and serves as a good washing bath. In one embodiment, the bath is at a temperature of −20° C. to 0° C. In another embodiment, the bath is at a temperature of 0° C. to 25° C. In yet another embodiment, the bath is at a temperature of 25° C. to 50° C. In still yet other embodiments, the bath is at a temperature of 50° C. to 100° C. In preferred embodiments, the filament is drawn through steam. Other plasticizers include isethionic acid, pyrrolidone, piperidine, morpholine, and glycerol, another preferred plasticizer. Alternatively, small batches of biofilaments may be drawn by hand or annealed in an oven under a tension weight.

The fibers are optionally washed in one or more wash baths. If the coagulant bath or baths was an alcohol bath, the fibers may be dried to evaporate the alcohol. Alternatively, the fibers may be washed in baths of successively lower concentration of the coagulant used, e.g., successively lower salt concentrations subsequent to a salt-based coagulant bath, until an ultimate water bath.

5.10. Drying and After Treatment

Following drawing and washing, the biofilament must be dried. Preferably, the biofilament is to be dried at temperatures below 100° C. Subsequently, treatments or coating agents may be applied. Agents may include, for example, lubricants, waxes, and anti-microbials, wetting agents, and other agents which enhance properties of the biofilament fibers as may be useful as finished commerical goods.

5.11. Filament Winding

The spun filament is wound onto a 25–80 mm OD plastic or paper spool. A lead of 7–20% is used between the final godet and winder speeds. Preferable winding speeds range between 0.7–1.0 m/min, but higher winding speeds may be practiced and may depend upon extrusion and drawing rates. A regulator sets the traverse rate, which sets the spacing between the filament layers wound onto the bobbin. The spun filament flow path is guided by a number of guides and the traverse guide to the winding spool.

5.12. Biofilament Finishes & Lubricants

An assortment of chemical finishes are available for spinning, weaving, knitting, and braiding productivity, as well as enhancement of functional properties. They combine low fiber to metal frictional properties, good inter-fiber cohesion, and excellent anti-static properties to maximize fiber, filament or yarn performance. For example 16–20% Lurol NF-782 aqueous emulsion spin finish is recommended for fine denier filament yarns, including nylon & polyester, with 0.8–1.2% take up on the weight of the yarn. The emulsion is prepared by adding the finish slowly into rapidly agitating 45–50° C. water. The emulsion should be translucent; opalescent in concentrations up to 20%. Typical properties include a clear yellow appearance of the liquid at 25°

C., gardner color <1, Viscosity cSt 56 and pH of 8.2 in 5% aqueous solution. It begins to freeze if stored below 10° C. If frozen, the product should be warmed above 25° C. and stirred before use to insure homogeneity. Preferably, an antibiotic or bactericide should be added to the emulsion to assure adequate storage life.

5.13. Addition of Finishes and Lubricants

The biofilament finishes according to the invention may contain lubricants known in the art in admixture with the described recombinant spider silk fiber. For example, polymer or wax surfactants or finishes may be used, including but not limited to mineral oils, fatty acid, for example palmitic acid, methyl ester, isobutyl stearate and/or tallow fatty acid, 2-ethylhexyl ester, polyol carboxyllic acid esters, coconut oil fatty acid esters of glycerol and/or alkoxylated glycerols, silicones, dimethyl polysiloxane, and/or polyalkylene glycols, and ethylene oxide/propylene oxide copolymers (see Chemiefasem, Textil-Industrie, 1977, page 335, for examples of more lubricants).

Usually ester-based anionic antistatic lubricants, such as Natural-type LUROL NF 782 (Goullston Technologies Inc., NC USA), can be used for enhancing silk processing. This is similar to the finishes used for nylon filaments. A suitable finish should have good cohesion and reduce the coefficient of friction between filament and machine components.

In addition to the lubricants, the biofilament finishes according to the invention may contain emulsfiers, wetting agents and/or antistatic agents and, optionally, standard auxiliaries, such as pH regulators, filament compacting agents, bactericides, and conductive polymers. Suitable emulsifiers, wetting agents and/or antistatic agents are anionic, cationic and/or nonionic surfactants, such as mono- and/or diglycerides, for example glycerol, mono- and/or dioleate, alkoxylated, preferably ethoxylated and/or propoxylated, fats, oils, fatty alcohols, castor oil containing 25 mol ethylene oxide (EO) and/or 16–18 fatty alcohol containing 8 mol propylene oxide and 6 mol EO, alkoxylated 8–24 fatty acid mono- and/or diethanolamides, e.g., optionally ethoxylated oleic acid mono- and/or diethanolamide, tallow fatty acid mono- and/or diethanolamide and/or coconut oil fatty mono- and/or diethanolamide, alkali metal and/or ammonium salts of alkoxylated, preferably ethoxylated and/or propoxylated, optionally end-capped 8–22 alkyl and/or 8–22 alkylene alcohol sulfonates, reaction products of optionally alkoxylated 8–22 alkyl alcohols with phosphorus pentoxide or phosphorus oxychloride in the form of their alkali metal, ammonium and/or amine salts, for example, phosphoric acid esters of ethoxylated 12–14 fatty alcohols, neutralized with alkanolamine, alkali metal and/or ammonium salts of 8–22 alkyl sulfosuccinates, such as sodium dioctyl sulfosuccinate and/or amine oxide, such as dimethyl dodecyl amine oxide. In considering this list of examples, it is important to bear in mind that many of the substances mentioned are not limited to one function, but may perform several functions. Thus, an antistatic agent may also act as an emulsifier.

Suitable filament compacting agents are the polyacrylates, fatty acid sarcosides and/or copolymers with maleic anhydride (Melliand Textilberichte (1977), page 197) and/or polyurethanes, pH regulators, for example $C_{1-4}$ carboxylic acids and/or $C_{1-4}$ hydroxycarboxylic acids, such as acetic acid and/or glycolic acid, alkali metal hydroxides, such as potassium hydroxide, and/or amines, such as triethanolamine, bactericides.

The biofilament finishes according to the invention are prepared by intensive mixing of the recombinant spider silk with the lubricants and, optionally, other lubricants, emulsifiers, wetting agents, antistatic agents and/or standard auxiliaries. In one embodiment, such finishes are applied to the silk protein at temperatures of 18–25° C.

As is standard in the textile industry, finishes are generally applied to the biofilament fibers in the form of aqueous dispersions immediately after the fibers leave the spinneret, following drawing, or during the drawing process. The spinning finishes are applied by applicator rolls or metering pumps in conjunction with suitable applicators. In one embodiment, the spinning finishes are at a temperature of 10–16° C. Finishes, in the form of aqueous dispersions, may have a total active substance content of 3–40% by weight and preferably 5 to 30% total substance content by weight. Based on their total active substance content, the spinning finishes according to the invention contain 35–100% by weight lubricants, 0–65% by weight emulsifiers, antistatic agents and/or wetting agents, and 0–10% by weight pH regulators, bactericides and/or corrosion inhibitors. The choice of finish and final amount are selected to optimize the desired properties of the fiber.

The quantity and form in which the finishes are applied are within the normal limits for the textile industry (e.g., 0.1–3.0% by weight). The fibers of the invention, either singly or even in admixture, may be provided with spinning finishes according to the invention. However, the spinning finishes according to the invention show particular advantages above all in their improved biodegradability.

5.14. Additives, Modifiers, and Auxiliaries

Recombinant spider silk proteins spun according to the specifications of the present invention may be coated with modifiers. Applications of such modified fibers could be, for example, in the construction of barrier webs or fabrics so that they are impermeable to liquids, permeable to gases, and impermeable to microorganisms. Modifiers that can be applied to spun spider silk fiber include, but are not limited to, the following: thermally conductive agents (e.g., graphite, boron nitride), ultraviolet-absorbing agents (e.g., benzoxazole, titanium dioxide, zinc oxide, benzophenone and its derivatives), water repellent agents (e.g., alkylsilane, stearic acid salts), therapeutic agents (e.g., antibiotics, hormones, growth factors, antihistamines, analgesics, anesthetics, anxyolytics), stain resistant agents (e.g., mesitol, CB-130), rot resistant agents (e.g., zinc chloride), adhesive agents (e.g., epoxy-resin, neoprene), anti-static agents (e.g., amines, amides, quaternary ammonium salts), biocidal agents (e.g., halogens, antibiotics, phenyl mercuric acetate), blood repellents (e.g., monoaldehyde urea resin), dye and pigments, electrically conductive agents (e.g., metal particles, zinc oxide, stannic oxide, indium oxide, carbon black, silver, nickel), electromagnetic shielding agents (e.g., hypophosphorous, carbon-phenol resin compounds), and flame-retardant agents (e.g., aluminum hydroxide, borax, polyamide, magnesium hydroxide, polypropylene).

5.15. Properties and Uses of Spider Silk Fibers

The spun fibers produced by the methods of the present invention may possess a diverse range of physical properties and characteristics, depending upon the initial properties of the source materials, i.e., the dope solution, and the coordination and selection of variable aspects of the present method practiced to achieve a desired final product, whether that product be a soft, sticky, pliable matrix conducive to cellular growth in a medical application or a load-bearing, resilient fiber, such as fishing line or cable.

The tensile strength of biofilaments spun by the methods of the present invention generally range from 0.03 g/d to 10 g/d. In one embodiment, the biofilament has a tensile strength of approximately 0.3 g/d and is useful in cell or tissue culture. In an alternate embodiment, the biofilament has a tensile stregth of approximately 1 g/d to 2 g/d and is useful in manufacturing sutures. In yet another alternate embodiment, the biofilament has a tensile strength of 4g/d to 8 g/d and is useful in manufacturing ligament replacements. In general, biofilaments intended for load-bearing uses preferably demonstrating a tensile strength of at least 1 g/d to 2 g/d, more preferably 2 g/d.

Such properties as elasticity and elongation at break vary depending upon the intended use of the spun fiber, but elasticity is preferably 3–4% or more, and elasticity for uses in which elasticity is a critical dimension, e.g., for products capable of being "tied," such as with sutures or laces, is preferably 10% or more. Water retention of spun fibers preferably is close to that of natural silk fibers, i.e., 11%.

The diameter of spun fibers can span a broad range, depending on the application; preferred fiber diameters range from 5, 10, 20, 30, 40, 50, 60 microns, up to 100–200 microns, 200 to 500 microns, and 500 to 1000 microns, but substantially thicker fibers may be produced, particularly for industrial applications (e.g., cable). In a specific embodiment, the diameter is 10–20 microns and is useful for manufacturing fine-grade sutures. In another specific embodiment, the diameter is 5–20 microns and is useful in manufacture of opthalmic sutures. It is also envisioned that cruder sutures could utilize biofilaments with diameters of approximately 60 microns. In yet another embodiment, the diameter is at least 100 microns and useful in veterinary applications. The cross-sectional characteristics of spun fibers may vary; e.g., preferable spun fibers include circular cross-sections, elliptical, starburst cross-sections, and spun fibers featuring distinct core/sheath sections, as well as hollow fibers. Wider diameters may be achieved by braiding or binding spun fibers together.

The spider silk fibers of the present invention may be used, e.g., spun together and/or braided or bundled, with a combination of spider silk proteins, as well as an assortment of other fiber types. Fibers may be spun using various spider silks (e.g., MaSpI, MaSpII, ADF-3) together, in various ratios, in a manner that emulates the practice of living spiders. For example, native orb-web spinning spider dragline silk is understood to contain a mixture of MaSpI and MaSpII in a 3:2 ratio; such a ratio is readily replicated by the present invention.

Preferred non-spider silk fibers to braid or bundle together with spider silk fibers include polymeric fibers (e.g., polypropylene, nylon, polyester), fibers and silks of other plant and animal sources (e.g., cotton, wool, *Bombyx mori* silk), and glass fibers. A highly preferred embodiment is spider silk fiber braided with 10% polypropylene fiber. The present invention contemplates that the production of such combinations of fibers can be readily practiced to enhance any desired characteristics, e.g., appearance, softness, weight, durability, water-repellant properties, improved cost-of-manufacture, that may be generally sought in the manufacture and production of fibers for medical, industrial, or commercial applications.

The use of biofilaments spun according to the methods of the present invention cover a broad and diverse array of medical, military, industrial and commercial applications. The fibers can be used in the manufacture of medical devices such as sutures, skin grafts, cellular growth matrices, replacement ligaments, and surgical mesh, and in a wide range of industrial and commercial products, such as, for example, cable, rope, netting, fishing line, clothing fabric, bullet-proof vest lining, container fabric, backpacks, knapsacks, bag or purse straps, adhesive binding material, non-adhesive binding material, strapping material, tent fabric, tarpaulins, pool covers, vehicle covers, fencing material, sealant, construction material, weatherproofing material, flexible partition material, sports equipment; and, in fact, in nearly any use of fiber or fabric for which high tensile strength and elasticity are desired characteristics.

6. EXAMPLES

The following examples are meant to illustrate the principles and advantages of the present invention. They are not intended to be limiting in any way.

6.1. Examples and Demonstrations of General Characteristics of the Invention

6.1.1. Fiber Drawing & Orientation

A series of continuous filaments were spun from purified recombinant spider silk protein polymer solution in accordance with the present invention in 100% methanol. Spun filament of about 0.2 m in length were drawn up to five fold in a 1 m long aqueous methanol bath with a pair of fine tip forceps and Acme® 1415, 1" fold back clips.

6.1.2. Fiber Surface & Cross-Section

Filaments spun from purified recombinant spider silk protein polymer solutions in accordance with the present invention into 80–100% methanol coagulant generally showed a circular or semi-circular cross section and a smooth surface with no deleterious surface features when observed at high magnifications with a low voltage Scanning Electron Microscope (SEM). The filament diameters ranged from 3–60 μm.

6.1.3. Fiber Toughness

The recombinant spider silk fiber produced was cured in 90% aqueous methanol and hand and machine drawn to over threefold draw ratio. The drawn fibers showed high toughness or higher resistance to breakage in comparison to the undrawn batches.

6.1.4. Fiber Surface, Cross-Section & Fracture

Figure 3:
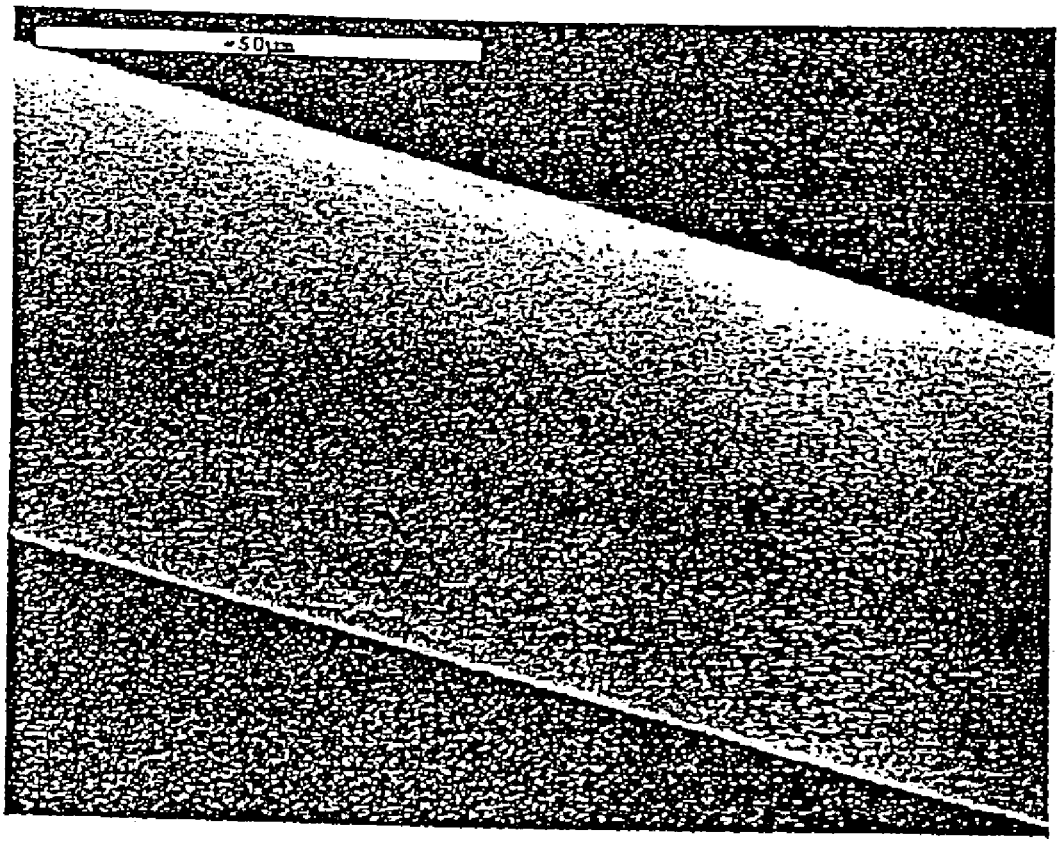
FIG. 3 is a scanning electron micrograph of the surface of a biofilament spun from recombinant spider silk protein.
Figure 4:
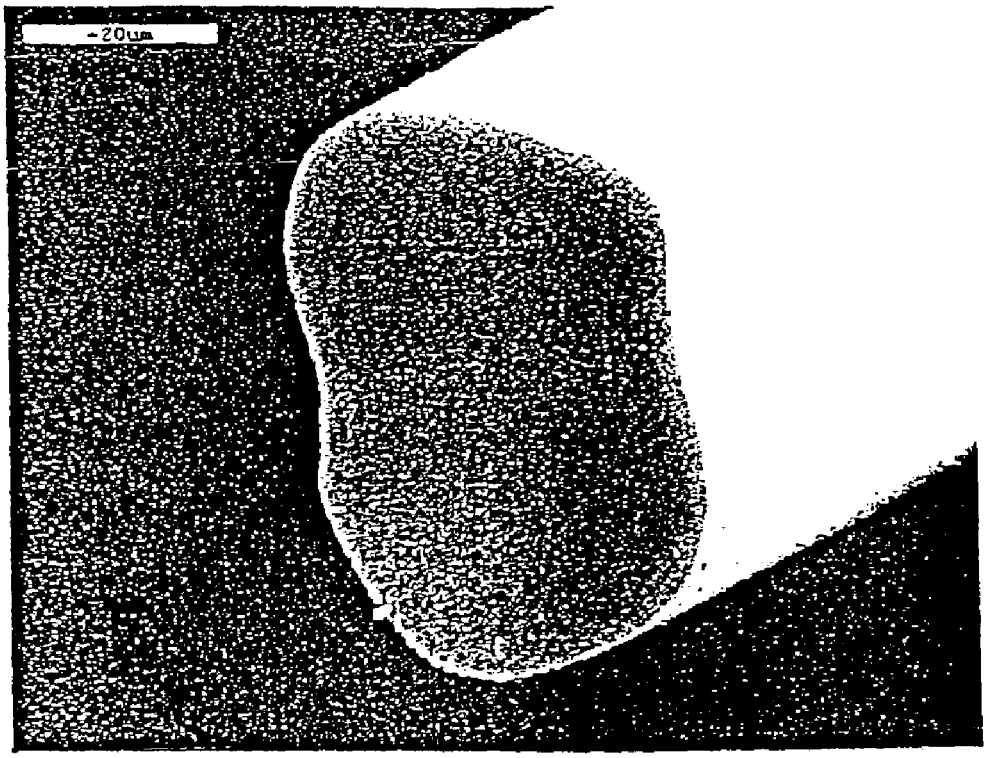
FIG. 4 is a scanning electron micrograph of a recombinant spider silk fiber in cross-section.

SEM images of the fiber surface (FIG. 3), cross-section (FIG. 4) and fracture (FIG. 5), revealed that a wide variety of fibers including hollow fibers could be produced for medical and industrial applications by chemical manipulations of fiber formation. These range from a highly porous hollow fiber to a solid, tough ductile structure. An array of cross-sectional shapes can be produced for specific applications.

6.1.5. Multi-filaments

Multi-filaments were produced by designing a multi-filament extrusion process incorporating spinnerets containing multiple orifices.

6.1.6. Effect of Post-spinning Drawing

In fiber science, it is well established that the effect of drawing is conducive to molecular orientation and alignment along the fiber axis. The DACA SpinLine spinning machine (DACA Instruments, Goleta, Calif.) is capable of imposing adequate drawing ratio to fibers processed by the machine. The drawing results from the speed differential between the godets, as shown in FIG. 1. Filaments were drawn in a mild aqueous chemical bath, e.g., methanol, and they showed good birefringence properties. Further study was done to determine the effect of drawing on the birefringence properties of recombinant spider silk fibers or filaments, as well as the effect on fibers generally.

6.1.7. Gel Inhibitors & pH Control

Addition of gelation inhibitors was explored for enhancing effective spinnability of the dope solution. Gelation prevents fiber formation. The formation of gel results from the interaction and chemical reaction between protein molecules. This also depends on buffer composition, concentration, pH, and time. Typically, the process of gelation is quicker with higher concentrations. The key consideration for selecting suitable gel inhibitors were chemical compatibility with the polymer and buffer, and maintaining molecular integrity of the polymer related to fiber formation. A range of organic chemicals and weak acids, for example phosphoric, formic, acetic, and propionic acid, or other additives, such as urea or guanidine hydrochloride, were used as gel inhibitors for recombinant spider silk dope solutions, depending on their suitability in terms of buffer and polymer composition (see, e.g., PCT publication WO 01/53333).

6.1.8. Plasma Treatments

Low-pressure plasma technology is suitable for enhancing functional surface properties of silk fibers, including improving affinity, hydrophilicity, and hydrophobicity.

6.1.9. Electrolytes

The addition of potassium nitrate, sodium chloride, and phosphates to the coagulant is to be explored to screen surface charge, which affects colloidal stability and protein-protein interactions.

6.1.10. Additives to Enhance Viscosity

A range of chemicals were added to the dope to enhance viscosity, for example polyethylene glycol/polyethylene oxide, glycerine, agar, alginate, carrageenan, gelatin, xanthan, modified celluloses, including carboxymethyl cellulose and hydroxyethyl cellulose, and commercially available super absorbent polymers (SAP), for example Aridallg® and ASAP4,D (BASF).

6.1.11. Plasticizers/Hydrogen Bonding Aid

Water was used as a plasticizer for spider silk. Plasticizers are additives used to enhance the softness, flexibility, and as a result, the practical workability of the fiber. Additional additives that have adequately function as plasticizers include free amino acids, isethionic acid, pyrrolidone, and morpholine. These may alter protein hydrogen bonding, or may affect or aid water retention in the structure.

6.1.12. Hybrids, Biocomponent and Unidirectional (UD) Structure

The mixtures and blends of compatible and incompatible (protein/non-protein) polymers, fibers, filaments, film, yarns, and fabrics are explored for designing new structures & product lines. This may result from process designing and modifications by electrostatic spinning, dry spinning, and wet spinning are procedures that can be used for developing spider silk fiber derivatives and products. Unidirectional technology claims good functional properties for soft ballistic protection with high-performance fibers.

6.1.13. Spider Silk-Fiber Composites

The FIBROLINE process impregnates fiber assemblies with powders (thermosetting, thermoplastic mineral cosmetics, etc) with the initiation of an alternating 10–50 kV electric field. The full extent of the process includes such components as: unwinding unit, powder scattering unit, Fibroline Impregnation unit, infra-red or thermal binding unit, cooler, cutter, and winding or plate staking.

6.1.14. Medical Adhesives

Spider silk can strengthen and/or modify adhesion, biodegradability and biocompatability of medical adhesives, e.g., spider silk fibers are chopped into approximately 0.1 to 10 mm lengths, preferably 5 mm in length and treated with medical adhesives as a reinforcing agent.

6.1.15. Spinning of Fibers of MaSpI and MaSpII Recombinant Spider Silk Proteins Purified from Transgenic Goat Milk Fibers may be spun using two spider silk proteins (the two protein components of the dragline silk) produced by recombinant means in the milk of transgenic goats. This example entails the spinning of MaSpI and MaSpII in various ratios. For example, MaSpI and MaSpII are mixed in a 3:2 ratio (the proposed stochiometry found in native silk) and spun to form filaments as described in Section 6.4, "Example 3."

6.1.16. Spider Silk Film

Spider silks can be made into film by further attenuation of the spinning process. The extruded filament can be processed through a pair of rotating coated pressing roller nips or inflated apron nips. Adjusting the flow rates and pressure on the nip rollers or inflated apron nip can control the thickness, width, and fineness of the film.

Spider silk films of the invention may be chemically modified. The $NH_2$ groups of spider silk can be covalently modified by acetylation, succinylation, crosslinking agents (such as glutaraldehyde or formaldehyde). Also, the COOH groups of the spider silk could be amidated using different amines. Additionally, recombinant spider silk can be derivatized with a polymer such as polyethylene glycol (PEG) using grafting, crosslinking, block copolymerization or end-grafted PEG-chain treatment of the recombinant spider silk films.

Such chemical modification can alter the mechanical properties of recombinant spider silk films or their biological interaction with cells when such films are used in in vivo or in vitro applications. In the latter case for example, this interaction can be studied in culture by using mouse or human fibroblasts or endothelial cells which are abundant in animals in connective and mail vessel tissues, respectively.

Alternatively, the modifications achieved (e.g., with PEG) can modulate the properties of the films to prevent bacterial colonization, but yet still allow attachment of the film to mammalian cells. Such a film could be readily applicable for industrial and medical uses, e.g., as a sealant, as wound dressing, or as a skin graft substitute.

6.2. Example 1

Figure 9:
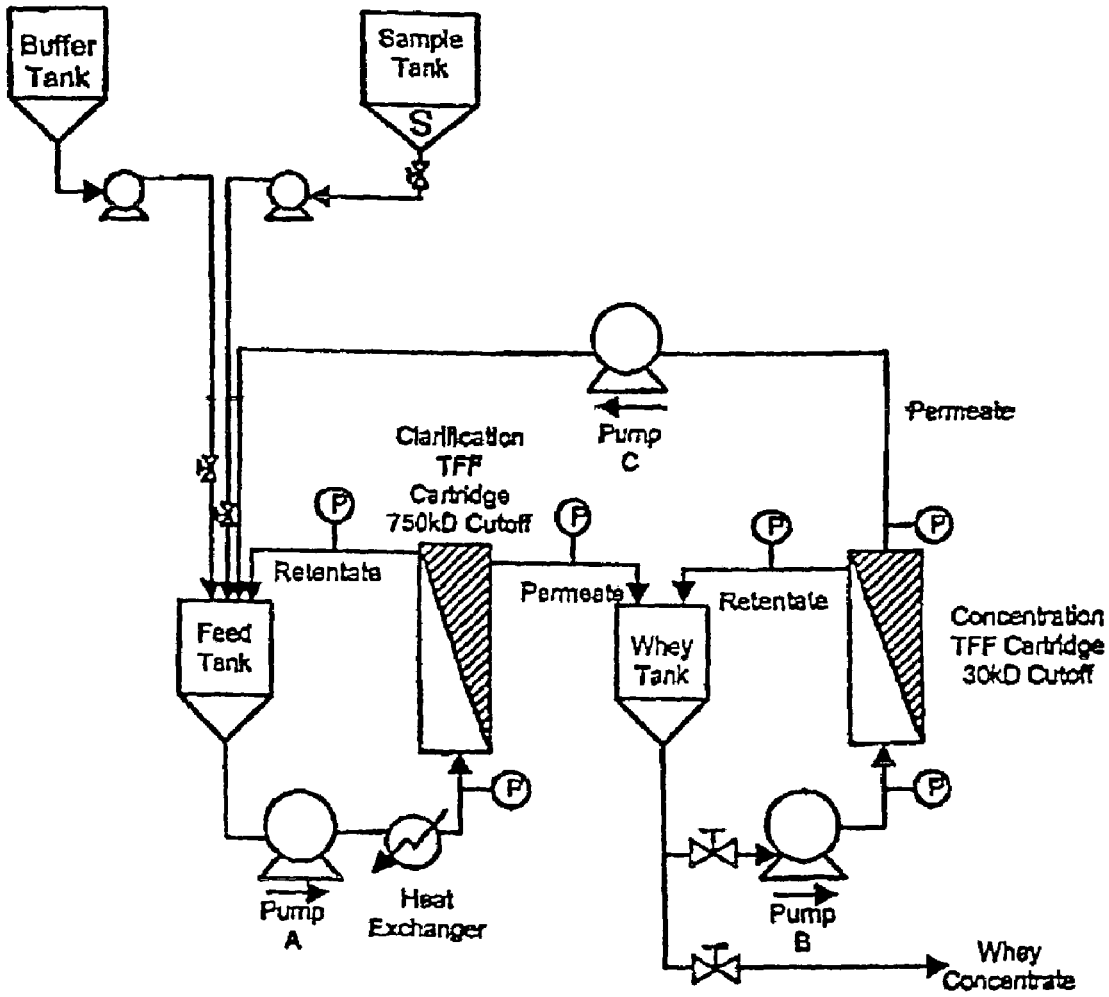
FIG. 9 is a schematic representation of a tangential flow filtration system which can be used for both clarification and concentration of biological fluid according to the methods of the invention. The system may be used in the clarification and concentration of milk produced by transgenic animals, as described in Example 1.

Purification of Recombinant MaSpII Spider Silk Protein from Transgenic Goat Milk A tangential flow filtration system was constructed as illustrated schematically in FIG. 9. A volume of 3180 ml of milk produced by transgenic goats (containing approximately 3000 mg of MaSpII) was placed in the Sample Tank. See U.S. patent application Ser. No. 10/341,097, entitled Recovery of Biofilament Proteins from Biological Fluids, filed Jan. 13, 2003, which is herein incorporated by reference in its entirety. The Buffer Tank was charged with 3180 ml of Buffer A (50 mM Arginine, pH 6.8) and connected to the Feed Tank. To start the clarification process, 3180 ml of Buffer A was introduced into the Feed Tank. Pump A was used to drive the clarification unit. A hollow fiber membrane cartridge of 750 kD cutoff (UFP-750-E-6A, A/G Technology Corp, Needham, Mass.) was equilibrated with Buffer A. The inlet pressure was adjusted to 5 psi and outlet pressure to 0 psi. The sample of 3180 ml transgenic milk containing MaSpII was then introduced into the Feed Tank. The sample was circulated through the clarification system, with the clarified permeate containing MaSpII being collected in the Whey Tank (permeate flux was 100 ml/minute) and the retentate being circulated back through the Feed Tank.

When the permeate volume collected in the Whey Tank reached 3180 ml, the concentration process was initiated and run simultaneously with the clarification process. Pump B was used to drive the concentration unit. A hollow fiber cartridge of 30 kD cutoff (UPF-30-E-6C, A/G Technology Corp., Needham, Mass.) was used to concentrate the clarified whey. In the concentration unit, the inlet pressure was adjusted to 15 psi and outlet pressure to 10 psi. Pump C was used to maintain the equilibrium of flow rates between the clarification and concentration units. The clarification process was run for a total of 260 minutes, during which eight feed volumes were circulated through the clarification system. The concentration process was continued until the final volume of retentate collected in the Whey Tank was reduced to 1815 ml. Analysis of the whey concentration by Western blot indicated approximately 2700 mg of MaSpII recovered.

The whey concentrate containing 2700 mg of MaSpI was then subjected to ammonium sulfate precipitation. Precisely 740 ml of 3.8M ammonium sulfate solution were added slowly to the 1815 ml of whey concentrate, with moderate stirring, to obtain a final concentration of ammonium sulfate of 1.1 M. The mixture was incubated at 4° C. overnight and the insoluble precipitate was recovered by centrifugation at 20000×g for one hour.

The precipitate was washed twice by homogeneous resuspension in 200 ml of 1.1 M ammonium sulfate solution followed by centrifugation at 2000×g for one hour. Three samples of 500 μl each were taken before the final centrifugation for analysis. Quantitative analysis of the samples was performed by UV absorbance spectroscopy at 280 nm, and qualitative analysis was performed by reverse phase HPLC. A total of 2112 mg of MaSpII protein in the form of a pellet was recovered with purity greater than 90%. The results were confirmed by SDS-PAGE/Silver staining and Western blot analysis.

6.3. Example 2

Preparation of Dope Solution of MaSpII Protein 6.3.1. Solubilization of the Spider Silk Protein Using Guanidine-HCl Approximately 0.5 ml of guanidine-HCl (6 M) was added to 413 mg of the MaSpII pellet obtained as described in Example 1. The pellet was carefully ground with a glass rod to obtain a homogeneous mixture. Another 80 ml of guanidine-HCl (6 M) was added to the mixture and then incubated at 60° C. in a water bath for 30 minutes. The suspension was briefly vortexed every 10 minutes during the 30 minute incubation period. Insoluble materials were removed from the MaSpII solution by decanting the supernatant following a one hour centrifugation at 30000×g (4° C.).

6.3.2. Buffer Exchange: Removal of Guanidine-HCl

Buffer exchange chromatography was performed using a Bio-Rad Biologic LP system (Bio-Rad Laboratories, Hercules, Calif., USA). A 5×25 cm Sephadex G-25 medium resin column (Amersham, Piscataway, N.J., USA) was prepared and equilibrated using 2.0 L of 50 mM glycine buffer (pH 11), at a flow rate of 10 ml/min. The MaSpII supernatant prepared in the previous section was loaded on the column and the column was flushed with the 50 mM glycine buffer (pH 11). Under these conditions the MaSpII protein eluted while the guanidine-HCl remained bound to the column. Chromatography was monitored using UV absorption spectroscopy and conductivity measurements of the effluent. A 200 ml fraction of MaSpII solution (~2.0 mg/ml) was collected.

6.3.3. Concentration of the MaSpII Solution

The MaSPII solution recovered in the above section was concentrated using a 400 ml Stirred Cell system (Millipore, Jaffrey, N.H., USA) equipped with a 10 kD cutoff YM 10 membrane (Millipore). The device was assembled according to manufacturer's instructions. The MaSpI solution (200 ml) was carefully added to the system and forced through the membrane at 55 psi. The MaSpII protein was retained in the retentate and the volume of MaSpII solution was reduced from 200 ml to 10 ml. The retentate was recovered and the concentration of MaSpII, measured by UV absorbance, was 40 mg/ml.

The MaSpII solution was further concentrated by centrifugal filtration. An Ultrafree-15 Centrifugal Filter Unit equipped with a Biomax-10 membrane (10 kDa cutoff) (Millipore) was used to concentrate 7.5 ml of the MaSpII solution by centrifugation at 2000×g for 20 minutes (4° C.). The retentate was gently mixed in the centrifugal device and re-centrifuged five times for 20 minutes until the volume was reduced to 1.4 ml. The final concentration of MaSpII solution, determined by Uv absorption spectroscopy, was 19.8% (w/v). Solutions thus prepared were subsequently used as the dope solution in subsequent examples herein.

6.4. Example 3

Biofilament Spinning Using a Methanol/Water/Acetic Acid Coagulant

For spinning, the dope collected in the above examples (18.8% w/v of MaSpII spider silk protein in 50 mM glycine buffer at pH 11; see Examples 1–2) was loaded into a 2.5 ml syringe (Hamilton Gastight 1002C) positioned in a DACA SpinLine spinning machine (DACA Instruments, Goleta, Calif.). The extruder barrel of the DACA SpinLine machine was modified to accommodate a syringe. The syringe was mounted vertically downward and the plunger was compressed by the screw driven motor of the DACA extruder, forcing the dope through a 1/16" PEEK tubing spinneret (0.127 mm orifice diameter; 50 mm length) into a room temperature coagulation bath containing 90% methanol, 9.4% water, and 0.6% acetic acid. The plunger extrusion speed was 0.6 mm/min. The typical resident time of the resulting biofilament in the coagulation bath was about 30 seconds. Some biofilament was wound on a bobbin (0.19 m diameter). Other portions of the extruded biofilament sample were hand-drawn to 2–4× their original length in a 36"×4" stainless steel bath containing similar coagulant. No washing was performed, because the coagulant quickly evaporated in air at room temperature. The unwound biofilaments were stored unsealed in 100 mm Petri dishes in lengths up to 2 m. Total filament length produced was approximately 70 m.

The biofilament samples were measured at 400× magnification using a Zeiss Telaval 31 microscope fitted with a 100×0.01 mm eyepiece reticule and calibrated with a 100×0.01 mm stage micrometer. At least two samples approximately 1 cm long from each lot were each measured at twelve positions for calculation of mean diameter and coefficient of variation. Linear density in denier units was calculated based on an assumed volume density and circular cross section. Fibers were generally smooth, white/opaque, and of uniform diameter (coefficient of variation 3 to 15%). Undrawn fiber diameter was typically 68 microns, or 40 denier, while drawn fibers were as fine as 33 microns (9.4 denier).

Tensile properties of the biofilament were tested on a Micro-AX350 advanced universal testing machine (SDL America Inc., Charlotte, N.C.). Percent elongation, load and energy were measured at peak and at break. Initial modulus was also measured, and peak tenacity and breaking toughness were calculated from the peak load and breaking energy respectively. Tensile tests were performed on a 25.4 mm gauge length at an extension rate of 10 mm/min. Where sample permitted, at least ten tests were performed on each lot. For the undrawn biofilament, the mean peak load was 20 gf, strain at break was 1.5% and energy at break was 0.51 gf cm. Peak tenacity was 0.52 g/d, initial modulus 35 g/d and breaking toughness 0.005 g/d. For the best lot in this experiment, drawing twice in the bath to a final draw ratio of approximately 4, resulted in a mean peak load at 14.6 gf, strain at break was 24%, energy at break was 7.7 gf cm, peak tenacity was 1.6 g/d, initial modulus was 52 g/d and breaking toughness was 0.32 g/d. Drawn biofilaments were generally ductile, with greater extensibility, tenacity and toughness than undrawn biofilaments.

mg/d, suspended in a clamp, and the linear density measured by the vibroscopic technique. The mean linear densities of biofilaments spun at 0.7 mm/min and not cured in the coagulation bath was 14 denier, while a biofilament spun at 3.05 mm/min and not cured was 48 denier. The linear density of a biofilament spun at 3.05 mm/min and cured for five minutes in the coagulation bath was 54 denier for undrawn biofilaments and 31 denier for the biofilaments drawn two-fold.

Tensile properties of the biofilaments were tested on a Micro-AX350 advanced universal testing machine (SDL America Inc., Charlotte, N.C.). Percent elongation, load and energy were measured at peak and at break. Initial modulus was also calculated, and peak tenacity and breaking toughness were calculated from the peak load and breaking energy respectively. Tensile tests were performed on a 25.4 mm gauge length at an extension rate of 10 mm/min. Where sample permitted, up to ten tests were performed on each lot. The results of these tests are summarized in Table 1 below.

TABLE 1

Biofilament Characterization

| Sample | Linear Density (d) | Peak Load (gf) | Strain at Break (%) | Energy at Break (gf cm) | Peak Tenacity (g/d) | Initial Modulus (g/d) | Breaking Toughness (g/d) |
|---|---|---|---|---|---|---|---|
| 0.7 mm/min Uncured | 14 | 3.9 | 4.4 | 0.30 | 0.29 | 18 | 0.0088 |
| 3.05 mm/min Uncured | 48 | 11 | 2.5 | 0.58 | 0.23 | 19 | 0.0047 |
| 3.05 mm/min Cured (avg. of 2) | 54 | 21 | 2.6 | 1.12 | 0.39 | 32 | 0.0082 |
| 3.05 mm/min Cured, drawn | 31 | 14 | 2.2 | 0.60 | 0.44 | 38 | 0.0076 |

6.5. Example 4

Biofilament Spinning Using Aluminum Sulfate Coagulant

The 1.0 ml syringe (Hamilton Gastight 1001 C) containing 0.65 ml of 19.8% (w/v) MaSpI dope solution was positioned in the DACA SpinLine spinning machine as described in Example 3. The dope solution was forced through a 1/16" PEEK tubing spinneret of 0.127 mm orifice diameter and 85 mm length, passed through a 90° tubing bend, directly into a room temperature coagulation bath (800 ml). The biofilament is pulled from the tip. The coagulant was prepared by dissolving 1 kg $Al_2(SO_4)_3$ (aluminum sulfate hydrate, CAS #16828-11-8), 100 g $Na_2SO_4$ (sodium sulfate anhydrous, CAS #7757-82-6) $H_2SO_4$ (sulphuric acid 95.0–98.0%, CAS#7664-93-9) in 2 L of water. The plunger extrusion speed varied between 0.7 and 3.05 mm/min (also ml of dope/hr). The resulting biofilament was cured in the coagulation bath for about five minutes and then drawn by hand in the same solution. Portions of the biofilament were drawn by hand to twice their original length. Biofilaments that were washed immediately after removal from the coagulation bath became sticky and difficult to handle. Thus, most biofilament fibers were not washed. The unwound fibers were stored unsealed in 100 mm Petri dishes in lengths of up to 1 m. Total filament length produced in this experiment was approximately 10 m.

Linear densities of the biofilaments were measured using a Lenzing Vibroskop 400 (W. Fritz Mezger Inc., Spartansburg, S.C.). Fibers were tensioned with approximately 65

The sample extruded at low speed (0.7 mm/min) holds very little load or energy. For the samples extruded at 3.05 mm/min, curing enhances most properties (peak load, tenacity, energy, modulus, toughness) while drawing was not sufficient to improve extensibility or toughness.

6.6. Example 5

Biofilament spinning using Aluminum Sulfate Coagulant and Modified Extrusion An 18% solution of MaSpII spider silk protein in aqueous 50 mM glycine buffer at pH 11 was prepared as described above in Examples 1–2 (Sections 6.2, 6.3) and loaded into a 1 ml syringe (Hamilton Gastight 1001C). Spinning was performed as described above, except that extrusion was through a 1/16" PEEK tubing spinneret of 0.127 mm orifice diameter and 93 mm length, passed through a 90° tubing bend, directly into a room temperature aluminum sulfate coagulation bath (2500 ml; see Example 4, Section 6.5). The plunger extrusion speed was varied between 0.8 and 0.9 mm/min. The coagulated dope was pulled from the extruder tip to produce short lengths of biofilament fiber which were hand drawn in the coagulant bath to yield fibers of varying linear densities. The unwound fibers were stored unsealed in 100 mm Petri dishes in lengths up to 1 m. Fibers were later washed in water to remove excess coagulant salt.

The linear density and tensile properties of the resulting biofilaments were determined as described in Example 4. The mean linear density of the finest fiber was 5.6 denier, the coarsest was 54 denier. The finest fiber was of sufficient length for only one test, and showed good extensibility (strain at break 13%), but a peak load of merely 1.9 gf. The coarser fibers held a mean peak load of 27.9 gf (n=8 samples tested), with the best sample holding 39.7 gf. For the coarsest fiber, mean strain at break was 12%, energy at break was 6.6 gf cm, tenacity was 0.52 g/d, modulus was 33 g/d, and toughness measured 0.048 g/d.

6.7. Example 6

Preparation of MaSpII Dope Solutions in Various Buffers

A number of buffers were investigated for the purpose of maintaining dope stability. A series of dope solutions were prepared in which the 50 mM glycine buffer (pKa 9.8) was replaced with the following buffer solutions:

(1) sodium L-ascorbate ($pK_a$ 11.8), 99+%, CAS #134-03-2;
(2) 6-aminohexanoic acid ($pK_a$ 10.8), 98%, CAS #60-32-2;
(3) 4-cyclohexylamino-1-butane sulfonic acid ($pK_a$ 10.8), min. 98%;
(4) piperidine ($pK_a$ 1.1), min. 99%, CAS #110-89-4;
(5) L-proline ($pK_a$ 10.6), 99+%, CAS #147-85-3; and
(6) Pyrrolidine ($pK_a$ 11.3), 99%, CAS #123-75-1.

All buffers were prepared to 50 mM and adjusted to pH 11 by dropwise addition of 50% (w/w) aqueous sodium hydroxide. A representative example, i.e., preparation of the dope solution in sodium L-ascorbate buffer is given below. All dope buffer solutions were prepared in a similar manner.

An MaSpII pellet (280 mg) recovered from transgenic goat milk from Example 1 above was dissolved in 56 ml of guanidine-HCl (6 M) as described in Example 2. The guanidine-HCl solute was replaced by buffer exchange with 50 mM glycine buffer (pH 11) as described in Section 6.3.2, resulting in 200 ml of 1.4 mg/ml MaSpII solution in 50 mM glycine buffer (pH 11), which was further concentrated using a Millipore stirred cell system, as described in Section 6.3.3, to yield 10 ml of 24 mg/ml MaSpII solution.

A 2 ml sample of the 24 mg/ml MaSpII solution was placed in a dialysis sac with a 12 kDa cutoff (Sigma-Aldrich). The dialysis sac was placed in a beaker containing 2L of 50 mM sodium L-ascorbate buffer (pH 11) and allowed to equilibrate for 16 hours at 4° C., resulting in approximately 200-fold dilution of the glycine buffer with the ascorbate buffer. The equilibrated solution was further concentrated using an Ultrafree-15 unit, as described in Section 6.3.3, resulting in a final volume of 0.22 ml MaSpII in sodium L-ascorbate buffer solution having a concentration of 17.1% (w/v), as determined by UV absorption spectroscopy. The 0.22 ml MaSpII in sodium L-ascorbate buffer solution was transferred to a syringe for fiber spinning.

Dope solutions of MaSpII in 50 mM buffers of 6-aminohexanoic acid, 4-cyclohexyl amino-1-butane sulfonic acid, piperidine, L-proline and pyrrolidine were prepared by the same methods.

6.8. Example 7

Dope Buffer Optimization for Biofilament Spinning

Biofilaments were spun from each of the MaSpII dope solutions prepared in previous example (Example 6, Section 6.7). For each solution, the dope was loaded into a 1 ml syringe (Hamilton Gastight 1001C) and spun using a DACA extruder. The dope solution was forced through a 1/16" PEEK tubing spinneret of 0.127 mm orifice diameter and 80 to 90 mm length, passed through a 90° tubing bend, directly into a methanol/water/acetic acid coagulation bath (90/9.4/0.6; 10° C.; see Example 3, Section 6.2.3). The plunger extrusion speed was 0.5, 0.7, or 0.9 mm/min. Biofilaments were cured in the coagulation bath for the duration of the extrusion process, then drawn by hand in the coagulant bath to 2–3 times their original length. No washing was performed. The unwound fibers were stored unsealed in 100 mm Petri dishes in lengths up to 1 m.

TABLE 2

Experimental Methods for Dope Buffer Optimization

| Dope Buffer (50 mM each) | Volume of solution | MaSpII conc. (w/v) | Extrusion speed | Length of fiber produced |
|---|---|---|---|---|
| sodium L-ascorbate | 0.22 ml | 17.1% | | |
| 4-cyclohexylamino-1-butane sulfonic acid (CABS) | 0.2 ml | 15.7% | | |
| Piperidine | 230 μl | 17.3% | 0.5–0.7 mm/min. | 8 m |
| Pyrrolidine | 270 μl | 19.5% | 0.7 mm/min. | 6 m |
| Glycine (control) | 230 μl | 15.7% | 0.5–0.9 mm/min | 4 m |

Linear density was measured using a Lenzing Vibroskop 400 (W. Fritz Mezger Inc., Spartansburg, S.C.), as described above, with the exception of the glycine control, which was instead estimated by measuring the fiber diameter by visual microscopy at 400× magnification. The tensile properties were measured as described above. The biofilaments spun from dope solutions buffered using the cyclic amines, piperidine and pyrrolidine, had substantially better properties than the glycine control.

TABLE 3

| Buffer | Draw Ratio | Linear Density (d) | Peak Load (gf) | Breaking Strain (%) | Breaking Energy (gf cm) | Peak Tenacity (g/d) | Initial Modulus (g/d) | Breaking Toughness (g/d) |
|---|---|---|---|---|---|---|---|---|
| | | Biofilament Characterization | | | | | | |
| Piperidine | 1 | 19.4 | 6.5 | 1.69 | 0.192 | 0.34 | 22 | 0.0039 |
| | 2 | 11.5 | 5.5 | 17.1 | 1.93 | 0.48 | 33 | 0.066 |
| | 3 | 8.6 | 4.6 | 26 | 2.9 | 0.54 | 22 | 0.131 |
| Pyrrolidine | 1 | 30 | 7.6 | 1.43 | 0.170 | 0.26 | 10.3 | 0.0022 |
| | 2 | 17.6 | 7.7 | 14.1 | 2.3 | 0.44 | 26 | 0.051 |
| | 3 | 16.7 | 6.0 | 324 | 5.1 | 0.36 | 28 | 0.121 |
| Glycine | 1 | 42 | 4.4 | 0.73 | 0.068 | 0.105 | 8.9 | 0.00064 |

6.9. Example 8

MaSpII Dope Solution Additives

A series of polar molecules with the potential to influence protein conformation and aggregation in solution were tested as dope additives. A solution of approximately 5% MaSpII protein was prepared as described in Example 2 (Section 6.3). Aliquots (2 ml) of the 5% MaSpII solution were mixed with equal volumes (2 ml) of additive solutions (500 mM) in 50 mM glycine buffer (pH 11). Accordingly, the resulting dope solutions were about 2.5% MaSpII and 250 mM additive in 50 mM glycine buffer. This dope was further concentrated to about 20% MaSpII protein as described in Example 2 (at Section 6.3), with the additive concentration remaining unchanged at 0.25M, and the glycine buffer concentration unchanged at 50 mM. The additives tested were betaine, choline chloride, sodium isethionate, DL-lysine monohydrochloride, potassium nitrate, taurine, and 2,2,2-trifluoroethanol.

6.10. Example 9

Biofilaments Spun From Additive-containing Dope Solutions

The dopes of the previous example (Example 8, Section 6.9) were loaded into a 1 ml syringe (tiamilton Gastight 1001C) and spun through a 1/16" PEEK tubing spinneret of 0.127 mm orifice diameter, passed through a 90° tubing bend, directly into a methanol/water/acetic acid coagulation bath (90/9.4/0.6; see Example 3, Section 6.4). The bath temperature was 12–18° C. The plunger extrusion speed was varied between 0.7 and 3.25 mm/min. The extruded biofilaments were cured in the coagulation bath for the duration of the extrusion process, then drawn by hand in the coagulant bath to 2–3 times their original length. No washing was performed. The unwound fibers were stored unsealed in 100 mm Petri dishes in lengths up to 1 m. The particular spinning conditions and results for the dope solutions containing the trifluoroethanol and isethionate additives, as well as a control solution are discussed below.

Trifluoroethanol: 340 μL of 19.0% dope was extruded through an 80 mm spinneret at a rate of 0.7 to 0.9 mm/min. A total of 17 m of biofilament was produced.

Isethionate: 340 μL of 15.4% dope was extruded through a 72 mm spinneret at a rate of 3.25 mm/min. A total of 8 m of biofilament was produced.

Control (no additive): 240 μL of 22.7% dope was extruded through an 87 mm spinneret at a rate of 0.9 mm/min. A total of 9 m of biofilament was produced.

The linear density and tensile properties of the spun biofilaments were measured as described previously (see Example 4, Section 6.5). The means are reported from tests performed on up to nine specimens from each lot, where available sample permitted.

TABLE 4

| Additive | Draw Ratio | Linear Density (d) | Peak Load (gf) | Breaking Strain (%) | Breaking Energy (gf cm) | Peak Tenacity (g/d) | Initial Modulus (g/d) | Breaking Toughness (g/d) |
|---|---|---|---|---|---|---|---|---|
| | | Biofilament Characterization | | | | | | |
| 2,2,2-Trifluoroethanol | 1 | 31 | 14.0 | 1.09 | 0.25 | 0.45 | 41 | 0.0031 |
| | 2 | 19.9 | 5.8 | 72 | 9.3 | 0.29 | 16 | 0.185 |
| | 3 | 13.7 | 9.5 | 100 | 20 | 0.69 | 34 | 0.59 |
| Sodium Isethionate | 1 | 34 | 15.1 | 1.24 | 0.30 | 0.44 | 36 | 0.0035 |
| | 2 | 8.0 | 5.9 | 18.0 | 2.1 | 0.74 | 40 | 0.105 |
| | 3 | 13.1 | 8.7 | 63 | 11.9 | 0.67 | 27 | 0.36 |
| None (Control) | 1 | 29 | 8.3 | 0.93 | 0.133 | 0.29 | 29 | 0.00183 |
| | 2 | 13.3 | 4.7 | 32 | 2.8 | 0.36 | 26 | 0.084 |
| | 3 | 6.7 | 3.9 | 57 | 4.9 | 0.59 | 32 | 0.29 |

Biofilaments spun from dope adulterated with 2,2,2-trifluoroethanol or sodium isethionate possessed substantially better tensile properties than the control. Drawn biofilaments had a reduced linear density and peak load, but greatly enhanced extensibility, breaking energy, and toughness.

6.11 Example 10

Polyethylene Oxide as an Additive to Dope Solution

A preferred additive of the invention, polyethylene oxide, is a particularly effective viscosity enhancer, adding stability and enhancing performance to the dope as it is spun and processed.

Polyethylene oxide (MW=5,000,000) was dissolved in water buffered to pH 11 with 50 mM glycine, at a concentration of 1% by weight. This polyethylene oxide solution was blended with the dope solution, as described in previous examples. Blending was done by magnetic stirrer in the concentrated dope and can also be added to the dilute dope during the dope concentration process. The final concentration ranged from 0.03% to as much as 0.2%.

This polyethylene oxide-containing dope was then spun through a spinneret into a coagulation bath 95% ethanol and 5% methanol. It was observed that the dope became highly stringy and was capable of being reeled at a rate of 6 m/minute, which is markedly higher relative to unmodified dope. As such, this feature increased the processability of the material.

Manual spinning directly into air was performed with the polyethylene oxideion enriched dope solution by drawing a rod from dope/additive mixture, resulting in strings of fiber, dried in air and freely formed. Such properties were not evident in control dope without the additive.

These properties exhibited by dope featuring the polyethylene oxide demonstrates a more durable dope of enhanced extensional viscosity capable of both wet spinning and dry spinning. Such properties as stability, throughput rate, and performance in mechanical handling to reel wet spun fiber through the spinning and drawing process, are improved with the polyethylene oxide. The extensional viscosity benefits provided by the additive are also critical for processability through electrospinning apparatus used for processing the recombinant spider silk protein fibers.

6.12. Example 11

Recombinant Spider Silk Films

The present invention also contemplates spider silk processed to form a planar film or sheet of silk, in addition to production as thread-like fiber. As such, spider silk films were cast using a 15.7% (W/v) dope solution of MaSpII (prepared as described in Examples 1 and 2, Sections 6.2–6.3), by placing approximately 100 μl of the solution into rounded 10×20 mm rectangular molds having depths of 51, 102, or 203 μm. The molds were machined on the surface of substrates composed of either 316 stainless steel (45 mm diameter×52 mm height), or Delrin® resin (Dupont) (60 mm diameter×53 mm height). Teflon substrates can also be used to cast these films (e.g., Teflon blocks of 78×18×6 mm outside dimension with molds of 66×6 mm having depths of 0.05, 0.1 or 0.2 mm).

The dope solution was spread evenly to cover the mold area with the aid of a glass slide. The films were allowed to air dry. Generally, the film took anywhere from 20 minutes to several hours to dry in this manner. In some experiments, various coagulation solutions were applied and spread to cover the surface of the films either shortly after casting, or after a solid film had formed. Details of some of these experiments are given below.

Experiment 1: 100 μl of dope solution, air dried for two hours at room temperature, film was peeled from mold.

Experiment 2: 100 μl of dope solution, methanol was added to surface of silk solution, precipitation was observed with no film formation.

Experiment 3: 100 μl of dope solution, air dried for 2 hours to overnight; 99% methanol added to surface of dried film; methanol was evaporated for 30 minutes to one hour, film was peeled from mold.

Experiment 4: 100 μl of dope solution, an aluminum sulfate coagulant solution (see Example 4, Section 6.2.4) was applied to the semi-dry film, or directly on the silk solution; treatment for 2 hours at room temperature, or overnight at room temperature; film was peeled from mold.

Films produced in Experiments 1, 3, and 4 could be manipulated easily. A qualitative determination of relative strength resulted in a rank order of 4>3>1. The resulting films could also be hydrated easily with water, acquiring higher elasticity than that of the dry state.

6.13. Example 12

Coagulation Diffusion Rates

A series of experiments were carried out to identify effective fiber-forming chemical compositions. There was no fiber formation (no precipitation) when the purified recombinant spider silk protein dope solution was extruded into a coagulation bath having 100% acetone. The same result occurred using a coagulation bath having 95% acetone and 5% methanol. An aqueous coagulation bath containing 80–100% methanol was suitable for extruding continuous biofilaments. Biofilament precipitation was not observed in aqueous coagulation baths having less than 50% methanol. Table 5 highlights examples of the compatible and incompatible coagulation chemicals for biofilament dope solutions.

Coagulation diffusion rates of the recombinant spider silk dope solution and a variety of coagulation bath solutions were analyzed using an analytical microscope. The coagulation diffusion rate was assessed by coverslipping 3–5 μL of a 14–18% dope solution on a glass slide. Using a light microscope, the dope solution boundary was brought into focus and then 5–10 μL of coagulation solutions were added under the cover slip. The coagulation boundary phase diffusion rate was evaluated.

Alternatively, coagulation was evaluated by adding a drop of dope solution to coagulant in a fifteen milliliter test tube. Typical coagulant chemicals used for this experiment included: $H_2O$, $CH_3OH$, $CH_3CH_2OH$, NaOH, $(NH_4)2SO_4$, $H_3PO_4$, and $H_2SO_4$. Table 5 highlights the coagulation experiments and evaluation of these experiments. A 100 μL Hamilton Gastight Syringe and 57.5 mm long 0.152 mm ID microbore blunt-cut stainless steel needle were used for extruding biofilament dope solutions into coagulation chemicals.

TABLE 5

Biofilament Dope Solution and Coagulation Bath Compatibility

| Biofilament Dope | Chemical Composition | Precipitation | Fibrous |
|---|---|---|---|
| M3** 14%–18% | 50% $CH_3OH$<br>50% $CH_3CH_2OH$ | Yes | Yes |
| M3 14%–18% | 100% $CH_3OH$ | Yes | Yes |
| M3 14%–18% | 100% $CH_3CH_2OH$ | Yes | Yes |
| M3 14%–18% | 50% $CH_3OH$<br>50% $H_2O$ | No | No |
| M3 14%–18% | 50% $CH_3CH_2OH$<br>50% $H_2O$ | No | No |

TABLE 5-continued

Biofilament Dope Solution and Coagulation Bath Compatibility

| Biofilament Dope | Chemical Composition | Precipitation | Fibrous |
|---|---|---|---|
| M3 14%–18% | 10% $H_3PO_4$<br>45% $CH_3OH$<br>45% $CH_3CH_2OH$ | Yes | Yes |
| M3 14%–18% | 10% $H_2SO_4$<br>40% $(NH_4)_2SO_4$<br>50% $H_2O$ | Yes | Yes |
| M3 14%–18% | 5% NaOH<br>80% $CH_3OH$ % $H_2O$ | No | No |
| M3 14%–18% | 50% NaOH<br>50% $H_2O$ | Yes | No |

**M3 = recombinant ADF-3 spider silk protein

Coagulation solutions containing a mixture of coagulants were used to find suitable coagulation chemicals and pH that were effective for fiber, film, or filament formation.

All publications and patent applications cited in this specification are herein incorporated by reference as if each individual publication or patent application were specifically and individually indicated to be incorporated by reference. The present invention is not to be limited in scope by the specific embodiments described herein. Indeed, as and although the foregoing invention has been described in some detail by way of illustration and example for purposes of clarity of understanding, it will be readily apparent to those of ordinary skill in the art, in light of the teachings of this invention via the foregoing description and accompanying figures, that certain changes and modifications may be made thereto without departing from the spirit or scope of the appended claims. Such modifications are intended to fall within the scope of the claims of the invention.

SEQUENCE LISTING

```
<160> NUMBER OF SEQ ID NOS: 29

<210> SEQ ID NO 1
<211> LENGTH: 34
<212> TYPE: PRT
<213> ORGANISM: Nephila clavipes
<220> FEATURE:
<223> OTHER INFORMATION: repeat motif found in Nephila spidroin I
      (MaSp 1) protein

<400> SEQUENCE: 1

Ala Gly Gln Gly Gly Tyr Gly Gly Leu Gly Ser Gln Gly Ala Gly Arg
 1               5                  10                  15

Gly Gly Leu Gly Gly Gln Gly Ala Gly Ala Ala Ala Ala Ala Ala Ala
            20                  25                  30

Gly Gly


<210> SEQ ID NO 2
<211> LENGTH: 47
<212> TYPE: PRT
<213> ORGANISM: Nephila clavipes
<220> FEATURE:
<223> OTHER INFORMATION: repeat motif found in Nephila spidroin 2
      (MaSp II) protein

<400> SEQUENCE: 2

Cys Pro Gly Gly Tyr Gly Pro Gly Gln Gln Cys Pro Gly Gly Tyr Gly
 1               5                  10                  15

Pro Gly Gln Gln Cys Pro Gly Gly Tyr Gly Pro Gly Gln Gln Gly Pro
            20                  25                  30

Ser Gly Pro Gly Ser Ala Ala Ala Ala Ala Ala Ala Ala Ala Ala
        35                  40                  45


<210> SEQ ID NO 3
<211> LENGTH: 4
<212> TYPE: PRT
<213> ORGANISM: Unknown
<220> FEATURE:
<223> OTHER INFORMATION: N. clavipes or A. diadematus or other
      silk-producing spider species
```

-continued

<400> SEQUENCE: 3

Ala Ala Ala Ala
1

<210> SEQ ID NO 4
<211> LENGTH: 4
<212> TYPE: PRT
<213> ORGANISM: Unknown
<220> FEATURE:
<223> OTHER INFORMATION: N. clavipes or A. diadematus or other
silk-producing spider species

<400> SEQUENCE: 4

Gly Ala Gly Ala
1

<210> SEQ ID NO 5
<211> LENGTH: 6
<212> TYPE: PRT
<213> ORGANISM: Unknown
<220> FEATURE:
<223> OTHER INFORMATION: N. clavipes or A. diadematus or other
silk-producing spider species

<400> SEQUENCE: 5

Gly Ala Gly Ala Gly Ala
1 5

<210> SEQ ID NO 6
<211> LENGTH: 8
<212> TYPE: PRT
<213> ORGANISM: Unknown
<220> FEATURE:
<223> OTHER INFORMATION: N. clavipes or A. diadematus or other
silk-producing spider species

<400> SEQUENCE: 6

Gly Ala Gly Ala Gly Ala Gly Ala
1 5

<210> SEQ ID NO 7
<211> LENGTH: 10
<212> TYPE: PRT
<213> ORGANISM: Unknown
<220> FEATURE:
<223> OTHER INFORMATION: N. clavipes or A. diadematus or other
silk-producing spider species

<400> SEQUENCE: 7

Gly Ala Gly Ala Gly Ala Gly Ala Gly Ala
1 5 10

<210> SEQ ID NO 8
<211> LENGTH: 12
<212> TYPE: PRT
<213> ORGANISM: Unknown
<220> FEATURE:
<223> OTHER INFORMATION: N. clavipes or A. diadematus or other
silk-producing spider species

<400> SEQUENCE: 8

Gly Ala Gly Ala Gly Ala Gly Ala Gly Ala Gly Ala
1 5 10

<210> SEQ ID NO 9
<211> LENGTH: 14

-continued

<212> TYPE: PRT
<213> ORGANISM: Unknown
<220> FEATURE:
<223> OTHER INFORMATION: N. clavipes or A. diadematus or other
silk-producing spider species

<400> SEQUENCE: 9

Gly Ala Gly Ala Gly Ala Gly Ala Gly Ala Gly Ala Gly Ala
1 5 10

<210> SEQ ID NO 10
<211> LENGTH: 7
<212> TYPE: PRT
<213> ORGANISM: Unknown
<220> FEATURE:
<223> OTHER INFORMATION: N. clavipes or A. diadematus or other
silk-producing spider species

<400> SEQUENCE: 10

Gly Gly Tyr Gly Gln Gly Tyr
1 5

<210> SEQ ID NO 11
<211> LENGTH: 8
<212> TYPE: PRT
<213> ORGANISM: Unknown
<220> FEATURE:
<223> OTHER INFORMATION: N. clavipes or A. diadematus or other
silk-producing spider species

<400> SEQUENCE: 11

Ala Ala Ala Ala Ala Ala Ala Ala
1 5

<210> SEQ ID NO 12
<211> LENGTH: 8
<212> TYPE: PRT
<213> ORGANISM: Unknown
<220> FEATURE:
<223> OTHER INFORMATION: N. clavipes or A. diadematus or other
silk-producing spider species

<400> SEQUENCE: 12

Gly Gly Ala Gly Gln Gly Gly Tyr
1 5

<210> SEQ ID NO 13
<211> LENGTH: 17
<212> TYPE: PRT
<213> ORGANISM: Unknown
<220> FEATURE:
<223> OTHER INFORMATION: N. clavipes or A. diadematus or other
silk-producing spider species

<400> SEQUENCE: 13

Gly Gly Gln Gly Gly Gln Gly Gly Tyr Gly Gly Leu Gly Ser Gln Gly
1 5 10 15

Ala

<210> SEQ ID NO 14
<211> LENGTH: 8
<212> TYPE: PRT
<213> ORGANISM: Unknown
<220> FEATURE:
<223> OTHER INFORMATION: N. clavipes or A. diadematus or other
silk-producing spider species

<400> SEQUENCE: 14

-continued

```
Ala Ser Ala Ala Ala Ala Ala Ala
 1               5


<210> SEQ ID NO 15
<211> LENGTH: 5
<212> TYPE: PRT
<213> ORGANISM: Unknown
<220> FEATURE:
<223> OTHER INFORMATION: N. clavipes or A. diadematus or other
      silk-producing spider species

<400> SEQUENCE: 15

Gly Pro Gly Gln Gln
 1               5


<210> SEQ ID NO 16
<211> LENGTH: 10
<212> TYPE: PRT
<213> ORGANISM: Unknown
<220> FEATURE:
<223> OTHER INFORMATION: N. clavipes or A. diadematus or other
      silk-producing spider species

<400> SEQUENCE: 16

Gly Pro Gly Gln Gln Gly Pro Gly Gln Gln
 1               5                   10


<210> SEQ ID NO 17
<211> LENGTH: 15
<212> TYPE: PRT
<213> ORGANISM: Unknown
<220> FEATURE:
<223> OTHER INFORMATION: N. clavipes or A. diadematus or other
      silk-producing spider species

<400> SEQUENCE: 17

Gly Pro Gly Gln Gln Gly Pro Gly Gln Gln Gly Pro Gly Gln Gln
 1               5                   10                  15


<210> SEQ ID NO 18
<211> LENGTH: 20
<212> TYPE: PRT
<213> ORGANISM: Unknown
<220> FEATURE:
<223> OTHER INFORMATION: N. clavipes or A. diadematus or other
      silk-producing spider species

<400> SEQUENCE: 18

Gly Pro Gly Gln Gln Gly Pro Gly Gln Gln Gly Pro Gly Gln Gln Gly
 1               5                   10                  15

Pro Gly Gln Gln
            20


<210> SEQ ID NO 19
<211> LENGTH: 25
<212> TYPE: PRT
<213> ORGANISM: Unknown
<220> FEATURE:
<223> OTHER INFORMATION: N. clavipes or A. diadematus or other
      silk-producing spider species

<400> SEQUENCE: 19

Gly Pro Gly Gln Gln Gly Pro Gly Gln Gln Gly Pro Gly Gln Gln Gly
 1               5                   10                  15

Pro Gly Gln Gln Gly Pro Gly Gln Gln
            20                  25
```

<210> SEQ ID NO 20
<211> LENGTH: 30
<212> TYPE: PRT
<213> ORGANISM: Unknown
<220> FEATURE:
<223> OTHER INFORMATION: N. clavipes or A. diadematus or other
silk-producing spider species

<400> SEQUENCE: 20

Gly Pro Gly Gln Gln Gly Pro Gly Gln Gln Gly Pro Gly Gln Gln Gly
1 5 10 15

Pro Gly Gln Gln Gly Pro Gly Gln Gln Gly Pro Gly Gln Gln
20 25 30

<210> SEQ ID NO 21
<211> LENGTH: 35
<212> TYPE: PRT
<213> ORGANISM: Unknown
<220> FEATURE:
<223> OTHER INFORMATION: N. clavipes or A. diadematus or other
silk-producing spider species

<400> SEQUENCE: 21

Gly Pro Gly Gln Gln Gly Pro Gly Gln Gln Gly Pro Gly Gln Gln Gly
1 5 10 15

Pro Gly Gln Gln Gly Pro Gly Gln Gln Gly Pro Gly Gln Gln Gly Pro
20 25 30

Gly Gln Gln
35

<210> SEQ ID NO 22
<211> LENGTH: 40
<212> TYPE: PRT
<213> ORGANISM: Unknown
<220> FEATURE:
<223> OTHER INFORMATION: N. clavipes or A. diadematus or other
silk-producing spider species

<400> SEQUENCE: 22

Gly Pro Gly Gln Gln Gly Pro Gly Gln Gln Gly Pro Gly Gln Gln Gly
1 5 10 15

Pro Gly Gln Gln Gly Pro Gly Gln Gln Gly Pro Gly Gln Gln Gly Pro
20 25 30

Gly Gln Gln Gly Pro Gly Gln Gln
35 40

<210> SEQ ID NO 23
<211> LENGTH: 12
<212> TYPE: PRT
<213> ORGANISM: Unknown
<220> FEATURE:
<223> OTHER INFORMATION: N. clavipes or A. diadematus or other
silk-producing spider species

<400> SEQUENCE: 23

Gly Pro Gly Gly Gln Gly Gly Pro Tyr Gly Pro Gly
1 5 10

<210> SEQ ID NO 24
<211> LENGTH: 10
<212> TYPE: PRT
<213> ORGANISM: Unknown
<220> FEATURE:
<223> OTHER INFORMATION: N. clavipes or A. diadematus or other -continued silk-producing spider species

<400> SEQUENCE: 24

Ser Ser Ala Ala Ala Ala Ala Ala Ala Ala
1 5 10

<210> SEQ ID NO 25
<211> LENGTH: 8
<212> TYPE: PRT
<213> ORGANISM: Unknown
<220> FEATURE:
<223> OTHER INFORMATION: N. clavipes or A. diadematus or other
silk-producing spider species

<400> SEQUENCE: 25

Gly Pro Gly Ser Gln Gly Pro Ser
1 5

<210> SEQ ID NO 26
<211> LENGTH: 5
<212> TYPE: PRT
<213> ORGANISM: Unknown
<220> FEATURE:
<223> OTHER INFORMATION: N. clavipes or A. diadematus or other
silk-producing spider species

<400> SEQUENCE: 26

Gly Pro Gly Gly Tyr
1 5

<210> SEQ ID NO 27
<211> LENGTH: 646
<212> TYPE: PRT
<213> ORGANISM: Nephila clavipes
<220> FEATURE:
<223> OTHER INFORMATION: Nephila spidroin I (MaSp 1) protein

<400> SEQUENCE: 27

Gln Gly Ala Gly Ala Ala Ala Ala Ala Ala Ala Gly Gly Ala Gly Gln
1 5 10 15

Gly Gly Tyr Gly Gly Leu Gly Ser Gln Gly Ala Gly Arg Gly Gly Gln
20 25 30

Gly Ala Gly Ala Ala Ala Ala Ala Ala Gly Gly Ala Gly Gln Gly Gly
35 40 45

Tyr Gly Gly Leu Gly Ser Gln Gly Ala Gly Arg Gly Gly Leu Gly Gly
50 55 60

Gln Gly Ala Gly Ala Ala Ala Ala Ala Ala Ala Gly Gly Val Gly Gln
65 70 75 80

Gly Gly Leu Gly Gly Gln Gly Ala Gly Gln Gly Ala Gly Ala Ala Ala
85 90 95

Ala Ala Ala Gly Gly Ala Gly Gln Gly Gly Tyr Gly Gly Leu Gly Ser
100 105 110

Gln Gly Ala Gly Arg Gly Gly Ser Gly Gly Gln Gly Ala Gly Ala Ala
115 120 125

Ala Ala Ala Ala Gly Gly Ala Gly Gln Gly Gly Tyr Gly Gly Leu Gly
130 135 140

Ser Gln Gly Ala Gly Arg Gly Gly Leu Gly Gly Gln Gly Ala Gly Ala
145 150 155 160

Ala Ala Ala Ala Ala Ala Gly Gly Ala Gly Gln Gly Gly Tyr Gly Gly
165 170 175

Leu Gly Gly Gln Gly Ala Gly Gln Gly Gly Tyr Gly Gly Leu Gly Ser

-continued

```
            180                 185                 190

Gln Gly Ala Gly Arg Gly Gly Leu Gly Gly Gln Gly Ala Gly Ala Ala
        195                 200                 205

Ala Ala Ala Ala Ala Gly Gly Ala Gly Gln Gly Gly Leu Gly Gly Gln
    210                 215                 220

Gly Ala Gly Gln Gly Ala Gly Ala Ala Ala Ala Ala Ala Gly Gly Ala
225                 230                 235                 240

Gly Gln Gly Gly Tyr Gly Gly Leu Gly Ser Gln Gly Ala Gly Arg Gly
                245                 250                 255

Gly Gln Gly Ala Gly Ala Ala Ala Ala Ala Ala Val Gly Ala Gly Gln
            260                 265                 270

Gly Gly Tyr Gly Gly Gln Gly Ala Gly Gln Gly Gly Tyr Gly Gly Leu
        275                 280                 285

Gly Ser Gln Gly Ala Gly Arg Gly Gly Leu Gly Gly Gln Gly Ala Gly
    290                 295                 300

Ala Ala Ala Ala Ala Ala Ala Gly Gly Ala Gly Gln Gly Gly Leu Gly
305                 310                 315                 320

Gly Gln Gly Ala Gly Gln Gly Ala Gly Ala Ala Ala Ala Ala Ala Gly
                325                 330                 335

Gly Ala Gly Gln Gly Gly Tyr Gly Gly Leu Gly Asn Gln Gly Ala Gly
            340                 345                 350

Arg Gly Gly Gln Gly Ala Ala Ala Ala Ala Ala Gly Gly Ala Gly Gln
        355                 360                 365

Gly Gly Tyr Gly Gly Leu Gly Ser Gln Gly Ala Gly Arg Gly Gly Leu
    370                 375                 380

Gly Gly Gln Gly Ala Gly Ala Ala Ala Ala Ala Ala Gly Gly Ala Gly
385                 390                 395                 400

Gln Gly Gly Tyr Gly Gly Leu Gly Gly Gln Gly Ala Gly Gln Gly Gly
                405                 410                 415

Tyr Gly Gly Leu Gly Ser Gln Gly Ser Gly Arg Gly Gly Leu Gly Gly
            420                 425                 430

Gln Gly Ala Gly Ala Ala Ala Ala Ala Ala Gly Gly Ala Gly Gln Gly
        435                 440                 445

Gly Leu Gly Gly Gln Gly Ala Gly Gln Gly Ala Gly Ala Ala Ala Ala
    450                 455                 460

Ala Ala Gly Gly Val Arg Gln Gly Gly Tyr Gly Gly Leu Gly Ser Gln
465                 470                 475                 480

Gly Ala Gly Arg Gly Gly Gln Gly Ala Gly Ala Ala Ala Ala Ala Ala
                485                 490                 495

Gly Gly Ala Gly Gln Gly Gly Tyr Gly Gly Leu Gly Gly Gln Gly Val
            500                 505                 510

Gly Arg Gly Gly Leu Gly Gly Gln Gly Ala Gly Ala Ala Ala Ala Gly
        515                 520                 525

Gly Ala Gly Gln Gly Gly Tyr Gly Gly Val Gly Ser Gly Ala Ser Ala
    530                 535                 540

Ala Ser Ala Ala Ala Ser Arg Leu Ser Ser Pro Gln Ala Ser Ser Arg
545                 550                 555                 560

Val Ser Ser Ala Val Ser Asn Leu Val Ala Ser Gly Pro Thr Asn Ser
                565                 570                 575

Ala Ala Leu Ser Ser Thr Ile Ser Asn Val Val Ser Gln Ile Gly Ala
            580                 585                 590

Ser Asn Pro Gly Leu Ser Gly Cys Asp Val Leu Ile Gln Ala Leu Leu
        595                 600                 605
```

-continued

```
Glu Val Val Ser Ala Leu Ile Gln Ile Leu Gly Ser Ser Ser Ile Gly
    610                 615                 620

Gln Val Asn Tyr Gly Ser Ala Gly Gln Ala Thr Gln Ile Val Gly Gln
625                 630                 635                 640

Ser Val Tyr Gln Ala Leu
                645


<210> SEQ ID NO 28
<211> LENGTH: 627
<212> TYPE: PRT
<213> ORGANISM: Nephila clavipes
<220> FEATURE:
<223> OTHER INFORMATION: Nephila spidroin 2 (MaSp II) protein

<400> SEQUENCE: 28

Pro Gly Gly Tyr Gly Pro Gly Gln Gln Gly Pro Gly Gly Tyr Gly Pro
 1               5                  10                  15

Gly Gln Gln Gly Pro Ser Gly Pro Gly Ser Ala Ala Ala Ala Ala Ala
            20                  25                  30

Ala Ala Ala Ala Gly Pro Gly Gly Tyr Gly Pro Gly Gln Gln Gly Pro
        35                  40                  45

Gly Gly Tyr Gly Pro Gly Gln Gln Gly Pro Gly Arg Tyr Gly Pro Gly
    50                  55                  60

Gln Gln Gly Pro Ser Gly Pro Gly Ser Ala Ala Ala Ala Ala Ala Gly
65                  70                  75                  80

Ser Gly Gln Gln Gly Pro Gly Gly Tyr Gly Pro Arg Gln Gln Gly Pro
                85                  90                  95

Gly Gly Tyr Gly Gln Gly Gln Gln Gly Pro Ser Gly Pro Gly Ser Ala
            100                 105                 110

Ala Ala Ala Ser Ala Ala Ala Ser Ala Pro Ser Gly Gln Gln Gly Pro
        115                 120                 125

Gly Gly Tyr Gly Pro Gly Gln Gln Gly Pro Gly Gly Tyr Gly Pro Gly
    130                 135                 140

Gln Gln Gly Pro Gly Gly Tyr Gly Pro Gly Gln Gln Gly Pro Ser Gly
145                 150                 155                 160

Pro Gly Ser Ala Ala Ala Ala Ala Ala Ala Ala Ser Gly Pro Gly Gln
                165                 170                 175

Gln Gly Pro Gly Gly Tyr Gly Pro Gly Gln Gln Gly Pro Gly Gly Tyr
            180                 185                 190

Gly Pro Gly Gln Gln Gly Pro Ser Gly Pro Gly Ser Ala Ala Ala Ala
        195                 200                 205

Ala Ala Ala Ala Ser Gly Pro Gly Gln Gln Gly Pro Gly Gly Tyr Gly
    210                 215                 220

Pro Gly Gln Gln Gly Pro Gly Gly Tyr Gly Pro Gly Gln Gln Gly Leu
225                 230                 235                 240

Ser Gly Pro Gly Ser Ala Ala Ala Ala Ala Ala Ala Gly Pro Gly Gln
                245                 250                 255

Gln Gly Pro Gly Gly Tyr Gly Pro Gly Gln Gln Gly Pro Ser Gly Pro
            260                 265                 270

Gly Ser Ala Ala Ala Ala Ala Ala Ala Ala Ala Gly Pro Gly Gly Tyr
        275                 280                 285

Gly Pro Gly Gln Gln Gly Pro Gly Gly Tyr Gly Pro Gly Gln Gln Gly
    290                 295                 300

Pro Ser Gly Pro Gly Ser Ala Ala Ala Ala Ala Ala Ala Gly Pro Gly
305                 310                 315                 320
```

-continued

```
Gln Gln Gly Leu Gly Gly Tyr Gly Pro Gly Gln Gln Gly Pro Gly Gly
                325                 330                 335

Tyr Gly Pro Gly Gln Gln Gly Pro Gly Gly Tyr Gly Pro Gly Ser Ala
            340                 345                 350

Ser Ala Ala Ala Ala Ala Ala Gly Pro Gly Gln Gln Gly Pro Gly Gly
        355                 360                 365

Tyr Gly Pro Gly Gln Gln Gly Pro Ser Gly Pro Gly Ser Ala Ser Ala
    370                 375                 380

Ala Ala Ala Ala Ala Ala Ala Gly Pro Gly Gly Tyr Gly Pro Gly Gln
385                 390                 395                 400

Gln Gly Pro Gly Gly Tyr Ala Pro Gly Gln Gln Gly Pro Ser Gly Pro
                405                 410                 415

Gly Ser Ala Ser Ala Ala Ala Ala Ala Ala Ala Ala Gly Pro Gly Gly
            420                 425                 430

Tyr Gly Pro Gly Gln Gln Gly Pro Gly Gly Tyr Ala Pro Gly Gln Gln
        435                 440                 445

Gly Pro Ser Gly Pro Gly Ser Ala Ala Ala Ala Ala Ala Ala Ala Ala
    450                 455                 460

Gly Pro Gly Gly Tyr Gly Pro Ala Gln Gln Gly Pro Ser Gly Pro Gly
465                 470                 475                 480

Ile Ala Ala Ser Ala Ala Ser Ala Gly Pro Gly Gly Tyr Gly Pro Ala
                485                 490                 495

Gln Gln Gly Pro Ala Gly Tyr Gly Pro Gly Ser Ala Val Ala Ala Ser
            500                 505                 510

Ala Gly Ala Gly Ser Ala Gly Tyr Gly Pro Gly Ser Gln Ala Ser Ala
        515                 520                 525

Ala Ala Ser Arg Leu Ala Ser Pro Asp Ser Gly Ala Arg Val Ala Ser
    530                 535                 540

Ala Val Ser Asn Leu Val Ser Ser Gly Pro Thr Ser Ser Ala Ala Leu
545                 550                 555                 560

Ser Ser Val Ile Ser Asn Ala Val Ser Gln Ile Gly Ala Ser Asn Pro
                565                 570                 575

Gly Leu Ser Gly Cys Asp Val Leu Ile Gln Ala Leu Leu Glu Ile Val
            580                 585                 590

Ser Ala Cys Val Thr Ile Leu Ser Ser Ser Ser Ile Gly Gln Val Asn
        595                 600                 605

Tyr Gly Ala Ala Ser Gln Phe Ala Gln Val Val Gly Gln Ser Val Leu
    610                 615                 620

Ser Ala Phe
625


<210> SEQ ID NO 29
<211> LENGTH: 629
<212> TYPE: PRT
<213> ORGANISM: Nephila clavipes
<220> FEATURE:
<223> OTHER INFORMATION: Nephila ADF-3 protein

<400> SEQUENCE: 29

Ala Arg Ala Gly Ser Gly Gln Gln Gly Pro Gly Gln Gln Gly Pro Gly
 1               5                  10                  15

Gln Gln Gly Pro Gly Gln Gln Gly Pro Tyr Gly Pro Gly Ala Ser Ala
            20                  25                  30

Ala Ala Ala Ala Ala Gly Gly Tyr Gly Pro Gly Ser Gly Gln Gln Gly
        35                  40                  45
```

-continued

```
Pro Ser Gln Gln Gly Pro Gly Gln Gln Gly Pro Gly Gly Gln Gly Pro
    50                  55                  60

Tyr Gly Pro Gly Ala Ser Ala Ala Ala Ala Ala Ala Gly Gly Tyr Gly
65                  70                  75                  80

Pro Gly Ser Gly Gln Gln Gly Pro Gly Gly Gln Gly Pro Tyr Gly Pro
                85                  90                  95

Gly Ser Ser Ala Ala Ala Ala Ala Ala Gly Gly Asn Gly Pro Gly Ser
            100                 105                 110

Gly Gln Gln Gly Ala Gly Gln Gln Gly Pro Gly Gln Gln Gly Pro Gly
        115                 120                 125

Ala Ser Ala Ala Ala Ala Ala Ala Gly Gly Tyr Gly Pro Gly Ser Gly
    130                 135                 140

Gln Gln Gly Pro Gly Gln Gln Gly Pro Gly Gly Gln Gly Pro Tyr Gly
145                 150                 155                 160

Pro Gly Ala Ser Ala Ala Ala Ala Ala Ala Gly Gly Tyr Gly Pro Gly
                165                 170                 175

Ser Gly Gln Gly Pro Gly Gln Gln Gly Pro Gly Gly Gln Gly Pro Tyr
            180                 185                 190

Gly Pro Gly Ala Ser Ala Ala Ala Ala Ala Ala Gly Gly Tyr Gly Pro
        195                 200                 205

Gly Ser Gly Gln Gln Gly Pro Gly Gln Gln Gly Pro Gly Gln Gln Gly
    210                 215                 220

Pro Gly Gly Gln Gly Pro Tyr Gly Pro Gly Ala Ser Ala Ala Ala Ala
225                 230                 235                 240

Ala Ala Gly Gly Tyr Gly Pro Gly Tyr Gly Gln Gln Gly Pro Gly Gln
                245                 250                 255

Gln Gly Pro Gly Gly Gln Gly Pro Tyr Gly Pro Gly Ala Ser Ala Ala
            260                 265                 270

Ser Ala Ala Ser Gly Gly Tyr Gly Pro Gly Ser Gly Gln Gln Gly Pro
        275                 280                 285

Gly Gln Gln Gly Pro Gly Gly Gln Gly Pro Tyr Gly Pro Gly Ala Ser
    290                 295                 300

Ala Ala Ala Ala Ala Ala Gly Gly Tyr Gly Pro Gly Ser Gly Gln Gln
305                 310                 315                 320

Gly Pro Gly Gln Gln Gly Pro Gly Gln Gln Gly Pro Gly Gln Gln Gly
                325                 330                 335

Pro Gly Gly Gln Gly Pro Tyr Gly Pro Gly Ala Ser Ala Ala Ala Ala
            340                 345                 350

Ala Ala Gly Gly Tyr Gly Pro Gly Ser Gly Gln Gln Gly Pro Gly Gln
        355                 360                 365

Gln Gly Pro Gly Gln Gln Gly Pro Gly Gln Gln Gly Pro Gly Gln Gln
    370                 375                 380

Gly Pro Gly Gln Gln Gly Pro Gly Gln Gln Gly Pro Gly Gln Gln Gly
385                 390                 395                 400

Pro Gly Gln Gln Gly Pro Gly Gly Gln Gly Ala Tyr Gly Pro Gly Ala
                405                 410                 415

Ser Ala Ala Ala Gly Ala Ala Gly Gly Tyr Gly Pro Gly Ser Gly Gln
            420                 425                 430

Gln Gly Pro Gly Gln Gln Gly Pro Gly Gln Gln Gly Pro Gly Gln Gln
        435                 440                 445

Gly Pro Gly Gln Gln Gly Pro Gly Gln Gln Gly Pro Gly Gln Gln Gly
    450                 455                 460
```

-continued

```
Pro Gly Gln Gln Gly Pro Tyr Gly Pro Gly Ala Ser Ala Ala Ala Ala
465                 470                 475                 480

Ala Ala Gly Gln Gln Gly Pro Gly Gln Gln Gly Pro Gly Gln Gln Gly
                485                 490                 495

Pro Gly Gln Gln Gly Pro Tyr Gly Pro Gly Ala Ala Ser Ala Ala Val
            500                 505                 510

Ser Val Gly Gly Tyr Gly Pro Gly Ser Ser Ser Val Pro Val Ala Ser
        515                 520                 525

Ala Val Ala Ser Arg Leu Ser Ser Pro Ala Ala Ser Ser Arg Val Ser
    530                 535                 540

Ser Ala Val Ser Ser Leu Val Ser Ser Gly Pro Thr Lys His Ala Leu
545                 550                 555                 560

Leu Ser Asn Thr Ile Ser Ser Val Val Ser Gln Val Ser Ala Ser Asn
                565                 570                 575

Pro Gly Leu Ser Gly Cys Asp Val Leu Val Gln Ala Leu Leu Glu Val
            580                 585                 590

Val Ser Ala Leu Val Ser Ile Leu Gly Ser Ser Ser Ile Gly Gln Ile
        595                 600                 605

Asn Tyr Gly Ala Ser Ala Gln Tyr Thr Gln Met Val Gly Gln Ser Val
    610                 615                 620

Ala Gln Ala Leu Ala
625
```

What is claimed is:

1. A method for producing a spider silk fiber, said method comprising extruding a dope solution comprising a recombinant spider silk protein, through a spinneret to form said spider silk fiber, wherein said recombinant spider silk protein is recovered from mammalian cell culture media, the milk of a transgenic mammal engineered to express said spider silk protein in its milk, the urine of a transgenic mammal, or an extract or exudate from a transgenic plant.

2. The method of claim 1, wherein said spider silk protein is a dragline silk protein.

3. The method of claim 2, wherein said dragline silk protein is MaSpI.

4. The method of claim 3, wherein said MaSpI protein comprises an amino acid sequence at least about 90% identity to the sequence Ala Gly Gln Gly Gly Tyr Gly Gly Leu Gly Ser Gln Gly Ala Gly Arg Gly Gly Leu Gly Gly Gln Gly Ala Gly Ala Ala Ala Ala Ala Ala Ala Gly Gly (SEQ ID NO: 1).

5. The method of claim 1, wherein said transgenic mammal engineered to express said spider silk protein in its milk is a goat.

6. The method of claim 1, wherein said dope solution is 25–50% (w/v) spider silk protein.

7. A method for producing a spider silk fiber, said method comprising extruding a dope solution through a spinneret to form said spider silk fiber, wherein said dope solution comprises two or more different spider silk proteins.

8. The method of claim 7, wherein said dope solution is 5–50% (w/v) spider silk protein.

9. The method of claim 1 or 7, wherein said spider silk fiber has a tensile strength of at least 2 g/d.

10. The method of claim 1 or 7, wherein said spider silk fiber has an elasticity of at least 10%.

11. The method of claim 1 or 7, wherein said dope solution is extruded into a liquid coagulation bath.

12. The method of claim 11, wherein said coagulation bath comprises ethanol.

13. The method of claim 12, wherein said ethanol is present in solution at 60–100% (v/v).

14. The method of claim 12, wherein said coagulation bath further comprises a surfactant.

15. The method of claim 13, wherein said coagulation bath further comprises a surfactant.

16. The method of claim 11, wherein said coagulation bath comprises ammonium sulfate, aluminum sulfate, sodium sulfate, magnesium sulfate or ammonium acetate.

17. The method of claim 16, wherein said coagulation bath further comprises a surfactant.

18. The method of claim 11, wherein the temperature of said coagulation bath is between 0° C. and 15° C.

19. The method of claim 11, wherein said spider silk fiber is extruded through an air gap prior to contacting said coagulation bath.

20. The method of claim 1 or 7, wherein said dope solution is extruded at 0.4–1 meters/mm.

21. The method of claim 1 or 7, wherein said spinneret comprises an orifice of 0.062–0.254 mm in diameter.

22. The method of claim 1 or 7, wherein said spinneret has a tube length of 20–200 mm.

23. The method of claim 1 or 7, wherein said spinneret comprises two or more orifices.

24. The method of claim 24, wherein said spinneret has tube lengths of less than 10 mm.

25. The method of claim 1 or 7, further comprising the step of winding said fiber on a spool, at a rate of 4 to 30 meters/mm.

26. The method of claim 1 or 7, wherein said dope solution comprises GABamide (γ-aminobutyramide), N-acetyltaurine, choline, betaine, isethionic acid, cysteic acid, lysine, seine, potassium nitrate, potassium dihydrogenphosphate, glycine, or highly saturated fatty acids.

27. The method of claim 1 or 7, wherein said method further comprises coating said spider silk fiber with mineral oil, a fatty acid, isobutyl-stearate, tallow fatty acid 2-ethylhexyl ester, polyol carboxylic acid ester, a coconut oil fatty acid ester of glycerol, an alkoxylated glycerol, a silicone, dimethyl polysiloxane, a polyalkylene glycol, ethylene oxide, or a propylene oxide copolymer.

28. The method of claim 1 or 7, wherein said dope solution comprises a viscosity enhancer.

29. The method of claim 28, further wherein said viscosity enhancer is polyethylene glycol, polyethylene oxide, ethylene oxide, sodium polystyrene sulfonate, sodium dextrane sulfate, glycerine, agar, alginate, carageenan, gelatin, xanthan, or modified cellulose.

30. The method of claim 29, wherein said substance is polyethylene oxide.

31. A fiber produced by the method of claim 1 or 7.

* * * * *